US011712915B2

(12) United States Patent
Okamoto et al.

(10) Patent No.: US 11,712,915 B2
(45) Date of Patent: Aug. 1, 2023

(54) SHEET BUNDLE DISCHARGING APPARATUS AND BOOKBINDING APPARATUS

(71) Applicant: CANON FINETECH NISCA INC., Misato (JP)

(72) Inventors: Koji Okamoto, Tsukubamirai (JP); Dai Matsubara, Moriya (JP); Keiichi Nagasawa, Minami-Alps (JP)

(73) Assignee: Canon Finetech Nisca Inc., Misato (JP)

( * ) Notice: Subject to any disclaimer, the term of this patent is extended or adjusted under 35 U.S.C. 154(b) by 286 days.

(21) Appl. No.: 16/965,771

(22) PCT Filed: Jan. 25, 2019

(86) PCT No.: PCT/JP2019/002506
§ 371 (c)(1),
(2) Date: Jul. 29, 2020

(87) PCT Pub. No.: WO2019/151140
PCT Pub. Date: Aug. 8, 2019

(65) Prior Publication Data

US 2021/0039417 A1 Feb. 11, 2021

(30) Foreign Application Priority Data

Jan. 30, 2018 (JP) ..... 2018-014187
Sep. 10, 2018 (JP) ..... 2018-169207
(Continued)

(51) Int. Cl.
*B42C 19/08* (2006.01)
*B42C 1/12* (2006.01)
(Continued)

(52) U.S. Cl.
CPC ..... *B42C 19/08* (2013.01); *B42C 1/12* (2013.01); *B42C 3/00* (2013.01); *G03G 15/6541* (2013.01); *B42C 9/0006* (2013.01)

(58) Field of Classification Search
CPC ..... B42C 19/08; B42C 3/00; B65H 31/30; B65H 2404/692; B65H 31/3027;
(Continued)

(56) References Cited

U.S. PATENT DOCUMENTS 3,948,385 A 4/1976 Shinomiya
6,339,685 B1 * 1/2002 Okamoto ..... H04N 1/00771 399/407
(Continued)

FOREIGN PATENT DOCUMENTS

CN 1448326 A 10/2003
CN 104229509 A 12/2014
(Continued)

OTHER PUBLICATIONS

Office Action dated Mar. 30, 2021, in Chinese Patent Application No. 201980011044.5.
(Continued)

*Primary Examiner* — Justin V Lewis
(74) *Attorney, Agent, or Firm* — Venable LLP

(57) ABSTRACT

A sheet bundle discharging apparatus K, including: a conveyance unit 66 configured to convey a sheet bundle; a guide unit 72 configured to guide the sheet bundle conveyed by the conveyance unit; a discharging unit 90 configured to discharge the sheet bundle to an outside of the sheet bundle discharging apparatus; and a receiving unit 81 configured to receive the sheet bundle guided by the guide unit, wherein the receiving unit includes: a contact portion 81*c* with which a leading end portion of the sheet bundle, which is guided by the guide unit, in a moving direction of the sheet bundle is
(Continued)

to be brought into contact; and a pushing portion 81*b*, which is formed integrally with the contact portion, and is configured to push a first surface of the sheet bundle, and wherein the receiving unit is rotatable between a first position and a second position, and is configured to receive the sheet bundle in the first position and rotate from the first position to the second position, thereby allowing the pushing portion to push the first surface of the sheet bundle to place a second surface of the sheet bundle, which is on a side opposite to the first surface, on the discharging unit.

15 Claims, 24 Drawing Sheets

(30) Foreign Application Priority Data

Dec. 27, 2018 (JP) ..... 2018-245918
Jan. 18, 2019 (JP) ..... 2019-006723

(51) Int. Cl.
*B42C 3/00* (2006.01)
*G03G 15/00* (2006.01)
*B42C 9/00* (2006.01)

(58) Field of Classification Search
CPC ..... B65H 2404/64; B65H 31/3054; B65H 2801/27; B65H 2801/48; B65H 2301/4473
USPC ..... 412/9, 11, 14, 18, 25, 26
See application file for complete search history.

(56) References Cited

U.S. PATENT DOCUMENTS

| | | | | |
|---|---|---|---|---|
| 6,430,382 | B1 | 8/2002 | Okamoto et al. | |
| 6,793,454 | B2 | 9/2004 | Brizzi | |
| 7,156,391 | B2 | 1/2007 | Okamoto et al. | |
| 9,446,921 | B2 | 9/2016 | Habara | |
| 9,890,010 | B2 | 2/2018 | Okamoto | |
| 2001/0030103 | A1 | 10/2001 | Runonen | |
| 2004/0141830 | A1 | 7/2004 | Yoshie et al. | |
| 2008/0136158 | A1* | 6/2008 | Brommer | B42C 19/08 281/21.1 |
| 2009/0103962 | A1* | 4/2009 | Fujii | B65H 45/18 399/265 |
| 2014/0131163 | A1 | 5/2014 | Yun et al. | |
| 2020/0070561 | A1 | 3/2020 | Okamoto et al. | |
| 2020/0189307 | A1 | 6/2020 | Okamoto et al. | |

FOREIGN PATENT DOCUMENTS

| | | | |
|---|---|---|---|
| EP | 1977906 | A2 | 10/2008 |
| IT | VI20 110 062 | A1 | 9/2012 |
| JP | S51-031273 | U | 3/1976 |
| JP | S55-161736 | A | 12/1980 |
| JP | S57-98444 | A | 6/1982 |
| JP | S62-186847 | U | 11/1987 |
| JP | H02-282122 | A | 11/1990 |
| JP | 2003-146512 | A | 5/2003 |
| JP | 2008-297064 | A | 12/2008 |
| JP | 2010-265094 | A | 11/2010 |
| WO | 2017/207474 | A1 | 12/2017 |

OTHER PUBLICATIONS

Int'l Preliminary Report on Patentability dated Aug. 13, 2020, in Int'l Patent Application No. PCT/JP2019/002506.
International Search Report dated Apr. 23, 2019, in PCT/JP2019/002506.
Search Report dated Oct. 11, 2021, in European Patent Application No. 19746874.7.
Office Action dated Jun. 28, 2022, in Japanese Patent Application No. 2019-006723.

* cited by examiner

FIG. 19

TABLE OF MOVEMENT START TIMING OF PUSHING MEMBER WITH RESPECT TO "LENGTH FROM SPINE PORTION TO FORE EDGE" AND "BASIS WEIGHT OF SHEET"

(NUMERICAL VALUE IS OPERATION START TIME INTERVAL FROM WHEN SPINE RECEIVER STARTS ROTATING UNTIL PUSHNING MEMBER STARTS MOVING)

| LENGTH FROM SPINE PORTION TO FORE EDGE | | BASIS WEIGHT OF SHEET | | |
|---|---|---|---|---|
| | | 52g - 63g | 64g - 80g | 81g - 105g |
| A4 | 182.1mm - 210mm | 1100ms | 1100ms | 800ms |
| B5 | 148.6mm - 182mm | 1100ms | 800ms | 800ms |
| A5 | 139.8mm - 148.5mm | 800ms | 800ms | 800ms |
| STMT | 137.5mm - 139.7mm | 800ms | 800ms | 800ms |

TABLE OF MOVEMENT START TIMING OF PUSHING MEMBER WITH RESPECT TO NUMBER OF INNER SHEETS OF BOOKLET

| NUMBER OF INNER SHEETS | 10 SHEETS - 30 SHEETS | 31 SHEETS - 50 SHEETS | 51 SHEETS - 100 SHEETS | 101 SHEETS - 150 SHEETS | 151 SHEETS - 200 SHEETS |
|---|---|---|---|---|---|
| MOVEMENT START TIMING OF PUSHING MEMBER | 800ms | 800ms | 800ms | 1100ms | 1100ms |

SHEET BUNDLE DISCHARGING APPARATUS AND BOOKBINDING APPARATUS

TECHNICAL FIELD

The present invention relates to a sheet bundle discharging apparatus configured to discharge a sheet bundle, and to a bookbinding apparatus including the same.

BACKGROUND ART

In PTL 1, there is disclosed a bookbinding apparatus including an accommodating section configured to accommodate a plurality of sheet bundles (booklets), which are each formed by binding a plurality of sheets each having an image formed thereon.

CITATION LIST

Patent Literature

PTL 1: Japanese Patent Application Laid-Open No. 2005-305822

SUMMARY OF INVENTION

Technical Problem

However, with regard to the accommodating section disclosed in PTL 1, every time the amount of sheet bundles accommodated on the accommodating section reaches a certain amount, a user is required to take out the sheet bundles. It is required that the operation of the bookbinding apparatus be stopped while the user takes out the sheet bundles from the accommodating section. Therefore, the bookbinding operation cannot be continuously performed, with the result that the productivity of the apparatus cannot be improved.

Solution to Problem

According to an embodiment of the present invention, there is provided a sheet bundle discharging apparatus, comprising: a conveyance unit configured to convey a sheet bundle; a guide unit configured to guide the sheet bundle conveyed by the conveyance unit; a discharging unit configured to discharge the sheet bundle to an outside of the sheet bundle discharging apparatus; and a receiving unit configured to receive the sheet bundle guided by the guide unit, wherein the receiving unit includes: a contact portion with which a leading end portion of the sheet bundle, which is guided by the guide unit, in a moving direction of the sheet bundle is to be brought into contact; and a pushing portion, which is formed integrally with the contact portion, and is configured to push a first surface of the sheet bundle, and wherein the receiving unit is rotatable between a first position and a second position, and is configured to receive the sheet bundle in the first position and rotate from the first position to the second position, thereby allowing the pushing portion to push the first surface of the sheet bundle to place a second surface of the sheet bundle, which is on a side opposite to the first surface, on the discharging unit.

According to an embodiment of the present invention, there is provided a bookbinding apparatus comprising: a binding unit configured to bind a sheet bundle; and the above-mentioned sheet bundle discharging apparatus.

Advantageous Effects of Invention

In the sheet bundle discharging apparatus according to one embodiment of the present invention, the first surface of the sheet bundle received by the receiving unit is pushed by the pushing portion, and the second surface of the sheet bundle is placed on the discharging unit, thereby being capable of obtaining a sheet bundle without bothering a user.

In the bookbinding apparatus according to one embodiment of the present invention, the sheet bundle discharging apparatus configured to discharge a sheet bundle is provided. Therefore, the sheet bundle having been subjected to the bookbinding can be taken out without stopping the operation of the apparatus, thereby being capable of improving the productivity of the bookbinding.

BRIEF DESCRIPTION OF DRAWINGS

FIG. 19 is a table for showing an operation start timing of the pushing member with respect to the length of the booklet and the basis weight of the sheet.

DESCRIPTION OF EMBODIMENTS

Now, with reference to the drawings, description is made of an image forming system which includes a bookbinding apparatus including a sheet bundle discharging apparatus according to an embodiment of the present invention. Numerical values given in the embodiment are numerical values for reference, and are not numerical values that delimit the present invention.

Figure 1:
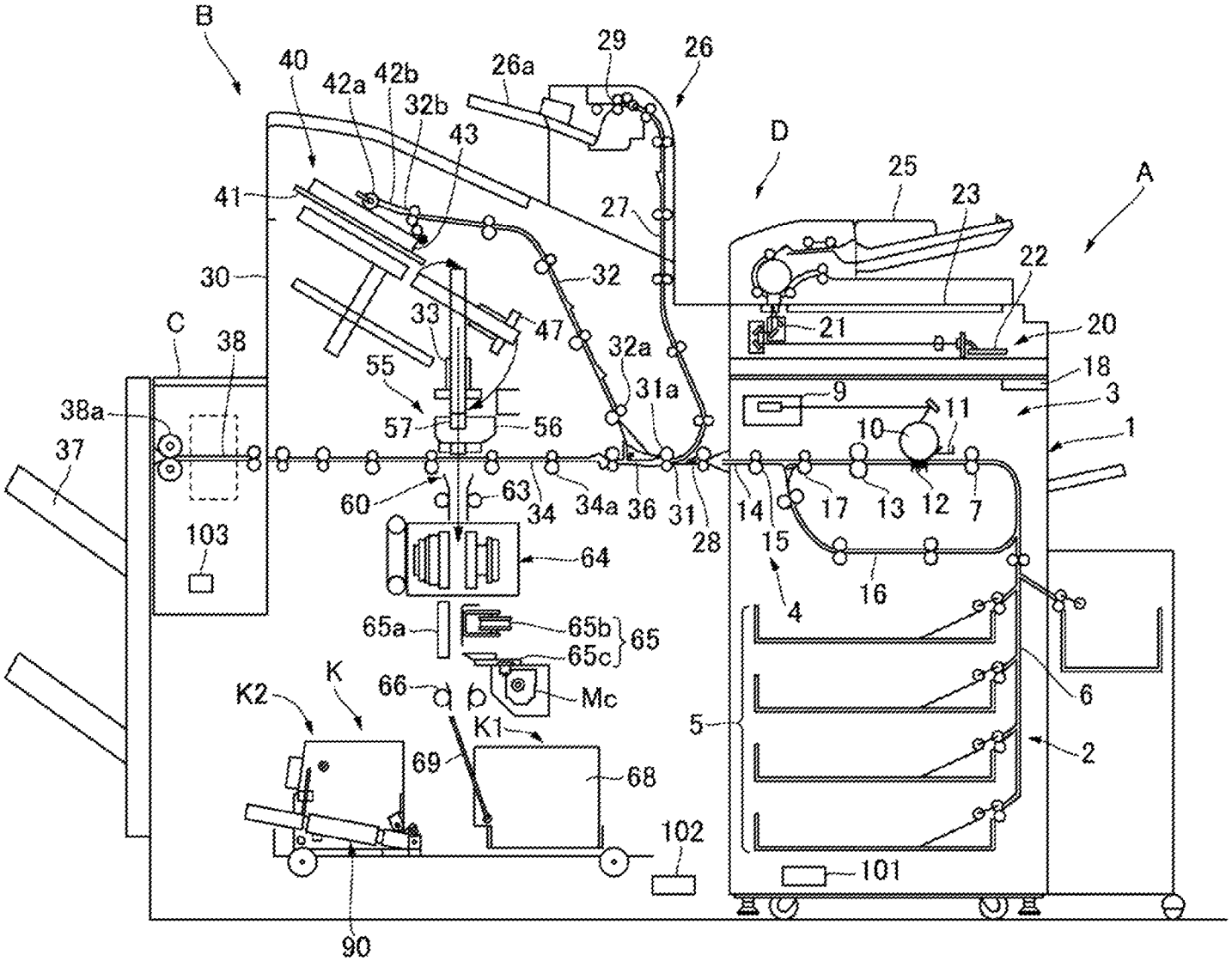
FIG. 1 is a schematic sectional view for illustrating an image forming system taken along a sheet conveyance direction.
Figure 2:
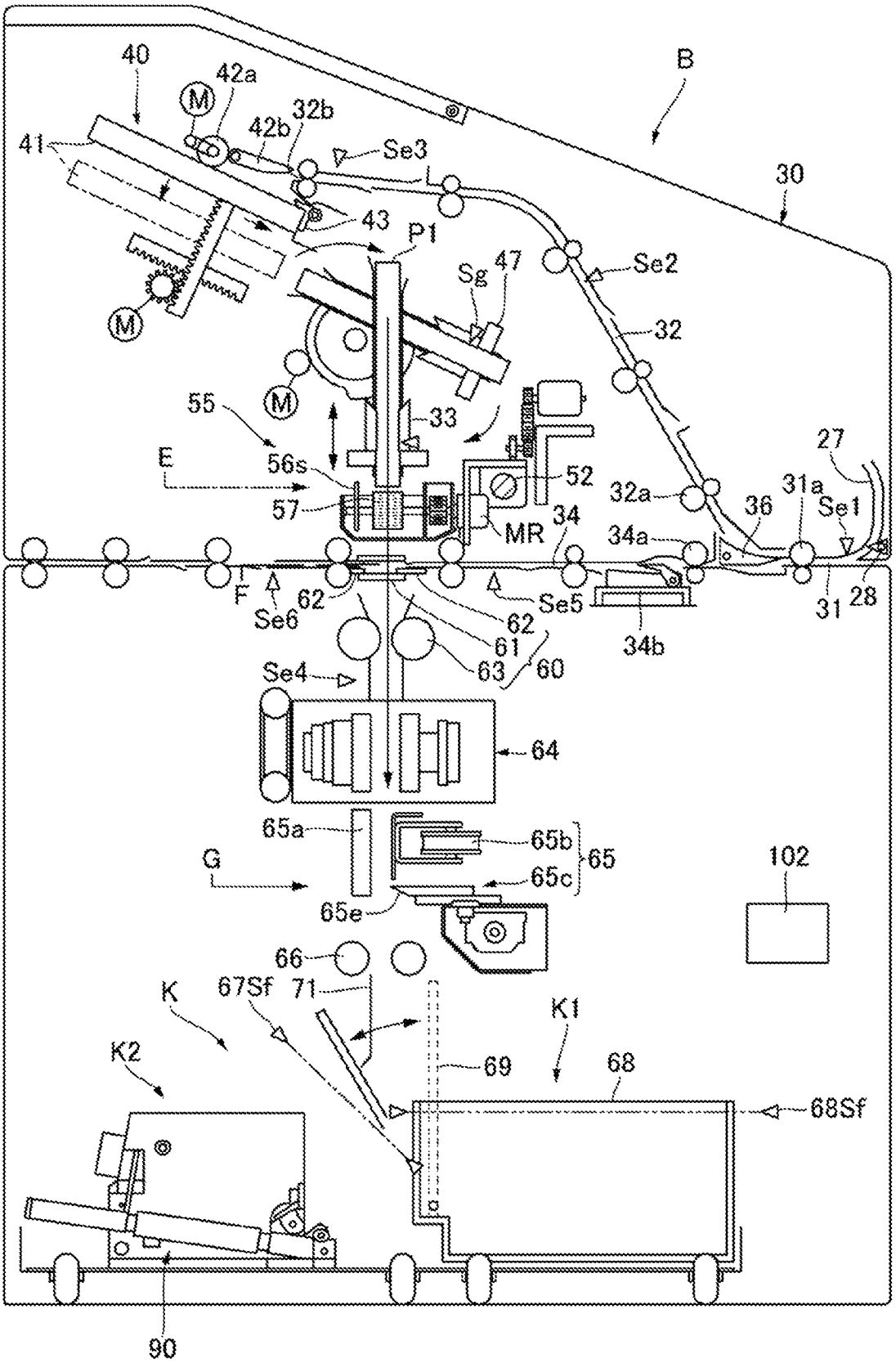
FIG. 2 is a schematic sectional view for illustrating a bookbinding apparatus according to an embodiment of the present invention taken along the sheet conveyance direction.

FIG. 1 is a schematic sectional view for illustrating an image forming system D taken along a sheet conveyance direction. FIG. 2 is a schematic sectional view for illustrating a bookbinding apparatus B taken along the sheet conveyance direction.

The image forming system D includes, for example, an image forming apparatus A, the bookbinding apparatus B, and a post-processing apparatus C. The image forming apparatus A is configured to sequentially form toner images on sheets. The bookbinding apparatus B is arranged on a downstream side of the image forming apparatus A. The post-processing apparatus C is arranged downstream of the bookbinding apparatus B. The image forming system D uses the bookbinding apparatus B to perform bookbinding processing on the sheets having been subjected to image formation in the image forming apparatus A. Further, the image forming system D allows sheets which are not subjected to the bookbinding processing to pass through the bookbinding apparatus B, uses the post-processing apparatus C to perform post-processing on the sheets, and discharges the sheets.

(Image Forming Apparatus A)

The image forming apparatus A is configured to form images on sheets. Examples of the image forming apparatus A may include those of various structures such as a copying machine, a printer, and a printing machine. The image forming apparatus A in this embodiment is a copying machine configured to form toner images on sheets. The image forming apparatus A includes, in an apparatus main body 1 thereof, a sheet supply portion 2, an image forming portion 3, a sheet discharging portion 4, and an image forming apparatus controller 101. In the sheet supply portion 2, a plurality of cassettes 5 corresponding to respective sheet sizes are arrayed in an up-and-down direction. The sheet supply portion 2 sends out a sheet having a size designated by the image forming apparatus controller 101 to a feed passage 6. In the feed passage 6, a registration roller pair 7 is provided. The registration roller pair 7 aligns a leading end of the sheet, and feeds the sheet to the image forming portion 3 on the downstream side at a predetermined timing.

The image forming portion 3 includes an electrostatic drum 10. In a periphery of the electrostatic drum 10, there are provided, for example, a print head 9, a developing device 11, and a transfer charger 12. The print head 9 is formed of, for example, a laser emitter, and is configured to form an electrostatic image on the electrostatic drum 10. The electrostatic image is developed with toner by the developing device 11 to be formed into a toner image. The toner image is transferred onto a sheet by the transfer charger 12. The toner image having been transferred onto the sheet is fixed on the sheet by a fixing device 13. After that, the sheet is delivered to a sheet discharging passage 17. The sheet discharging portion 4 has a sheet discharging port 14, and includes a sheet discharging roller pair 15 arranged therein. In a circulation passage 16, the sheet having been discharged from the sheet discharging passage 17 is delivered to a switchback passage to be reversed front and back, and thereafter is guided to the registration roller pair 7 again. A toner image is formed on a back surface of the sheet by the image forming portion 3. In such a manner, the sheet having the toner image formed on one side or both sides is fed from the sheet discharging port 14 to the bookbinding apparatus B by the sheet discharging roller pair 15.

A scanner unit 20 provided on top of the apparatus main body 1 is configured to optically read an image of an original. As generally known, the scanner unit 20 includes, for example, a platen glass 23, a carriage 21, and an optical reader (for example, CCD device) 22. The platen glass 23 is configured to receive an original to be placed thereon by a user. The carriage 21 is configured to optically read an original along the platen glass 23. The optical reader 22 is configured to perform photoelectric conversion on an optical image transmitted from the carriage 21. Further, the scanner unit 20 includes, on top thereof, an original feeder 25 configured to automatically feed an original to the platen glass 23.

(Bookbinding Apparatus B)

FIG. 2 is a schematic sectional view for illustrating the bookbinding apparatus B taken along the sheet conveyance direction. The bookbinding apparatus B is connected to the image forming apparatus A.

In the following description, a sheet which serves as a cover sheet of a sheet bundle is referred to as "cover sheet". A sheet covered with the cover sheet is referred to as "inner sheet". A bundle of inner sheets is referred to as "inner sheet bundle". The inner sheet bundle covered with the cover sheet is referred to as "sheet bundle covered with the cover sheet". A sheet bundle covered with the cover sheet which has been trimmed is referred to as "booklet". Those sheet bundles are simply referred to as "sheet bundle" in some parts.

The bookbinding apparatus B mainly includes the following elements, that is, a casing 30, a stacking portion 40, an adhesive applying portion 55, a cover sheet binding portion 60, a bundle attitude deflecting portion 64, a cutting portion 65, and a sheet bundle discharging apparatus K. The stacking portion 40 is provided in the casing 30, and is configured to stack inner sheets having toner images formed thereon into a bundle and then align the bundle. The adhesive applying portion 55 is configured to apply an adhesive to the inner sheet bundle from the stacking portion 40. The cover sheet binding portion 60 is configured to bind a cover sheet on the inner sheet bundle having the adhesive applied thereto. The bundle attitude deflecting portion 64 is configured to change an orientation of a sheet bundle covered with a cover sheet to which the cover sheet has been bound. The cutting portion 65 is configured to perform trim-cutting on the edge of the sheet bundle having been changed in orientation. The sheet bundle discharging apparatus K is configured to discharge the booklet formed as a result of the trim-cutting.

(Configuration of Conveyance Passage)

Description is made of each conveyance passage for the sheets. In the casing 30, there is provided a carry-in passage 31 which continues from the sheet discharge port 14 of the image forming apparatus A. The carry-in passage 31 is connected to an inner sheet conveyance passage 32 and a cover sheet conveyance passage 34 through intermediation of a passage switching member 36. The inner sheet conveyance passage 32 is connected to a bookbinding passage 33 through intermediation of the stacking portion 40. The cover sheet conveyance passage 34 is connected to a post-processing passage 38 of the post-processing apparatus C (FIG. 1) described later. The bookbinding passage 33 extends vertically through the bookbinding apparatus B in a substantially vertical direction. The cover sheet conveyance passage 34 extends horizontally through the bookbinding apparatus B in a substantially horizontal direction. Therefore, the bookbinding passage 33 and the cover sheet conveyance passage 34 cross each other (are orthogonal to each other), and the cover sheet binding portion 60 described later is arranged at the crossing part.

With the configuration of the conveyance passages as described above, the carry-in passage 31 receives, from the image forming apparatus A, sheets (inner sheets) having toner images formed thereon. In this case, the inner sheets and a print sheet (cover sheet), which is to be used as a cover sheet and has a title and the like printed thereon, are fed from the image forming apparatus A. The inner sheets and the cover sheet are selectively delivered to the inner sheet conveyance passage 32 and the cover sheet conveyance passage 34 by the passage switching member 36.

Moreover, an inserter apparatus 26 is connected to the carry-in passage 31 (FIG. 1). The inserter apparatus 26 is configured to feed cover sheets, which are not subjected to printing in the image forming apparatus A, one after another from a sheet feeding tray 26*a* to the carry-in passage 31. The inserter apparatus 26 includes one or a plurality of sheet feeding tray 26*a*, a cover sheet feeding portion 29, and a cover sheet feeding passage 27. The cover sheet feeding portion 29 is arranged at a distal end of the tray, and is configured to separate and feed one after another sheets stacked on the sheet feeding tray 26*a*. The cover sheet feeding passage 27 is provided on a downstream side of the cover sheet feeding portion 29. The cover sheet feeding passage 27 is connected to the carry-in passage 31 through intermediation of a passage switching member 28. A conveyance roller pair 31*a* is arranged on the carry-in passage 31. A conveyance roller pair 32*a* is arranged on the inner sheet conveyance passage 32. On the bookbinding passage 33, there are provided, for example, a grip conveyance portion 47, the bundle attitude deflecting portion 64 described later, and a sheet bundle discharging roller pair (conveyance unit) 66. A conveyance roller pair 34*a* is arranged on the cover sheet conveyance passage 34, and a conveyance roller pair 38*a* is arranged on the post-processing passage 38 of the post-processing apparatus C (FIG. 1) described later. The conveyance roller pair 34*a* and the conveyance roller pair 38*a* are rotated by respective drive motors (not shown) to feed the inner sheets and the cover sheet.

(Post-Processing Apparatus C)

In FIG. 1, the post-processing apparatus C is connected to the bookbinding apparatus B. The post-processing apparatus C includes the post-processing passage 38 continuing from the cover sheet conveyance passage 34. At least one post-processing device such as a stapling unit, a punching unit, or a center-binding unit is arranged on the post-processing passage 38. The post-processing passage 38 receives, through the cover sheet conveyance passage 34, sheets having been subjected to image formation and delivered from the image forming apparatus A. The post-processing apparatus C performs at least one post-processing such as stapling, punching, or center-binding on the sheets having been subjected to image formation. Then, the post-processing apparatus C conveys the sheets having been subjected to image formation to a discharge tray 37. Moreover, in some cases, the post-processing apparatus C discharges the sheets having been subjected to image formation to the discharge tray 37 without performing the post-processing.

(Stacking Portion 40)

A stack tray 41 arranged at an inner sheet discharging port 32*b* of the inner sheet conveyance passage 32 is configured to stack and accommodate the inner sheets, which have been discharged from the inner sheet discharging port 32*b*, in a bundle shape. As illustrated in FIG. 2, the stack tray 41 is formed of a tray member arranged in a substantially horizontal attitude, and there are arranged a forward/reverse rotation roller 42*a* and a carry-in guide 42*b* above the stack tray 41. Then, the inner sheets having been discharged from the inner sheet discharging port 32*b* are guided to a position above the stack tray 41 by the carry-in guide 42*b*, and are accommodated on the stack tray 41 by the forward/reverse rotation roller 42*a*. The forward/reverse rotation roller 42*a* performs forward rotation to deliver the inner sheets toward a distal end side of the stack tray 41, and performs reverse rotation to bring a trailing edge of the inner sheets into contact with a regulation member 43 arranged at a tray rear end (right end in FIG. 2), to thereby regulate the inner sheets. A pair of sheet side alignment plates (not shown) are provided to the stack tray 41, and the sheet side alignment plates align both side edges of the inner sheets accommodated on the stack tray 41. Moreover, along with stacking of the inner sheets, the stack tray 41 is lowered from the position indicated by the solid lines to the position indicated by the broken lines. With such a configuration, the inner sheets having been delivered from the inner sheet conveyance passage 32 are sequentially stacked on the stack tray 41, and then are aligned into a bundle shape.

(Grip Conveyance Portion 47)

The grip conveyance portion 47 is provided on the bookbinding passage 33. The grip conveyance portion 47 is configured to deliver the sheets from the stack tray 41 to an adhesive applying position E on the downstream side. The stack tray 41 passes the inner sheet bundle to the grip conveyance portion 47 which waits at a substantially horizontal passing position. As illustrated in FIG. 2, the grip conveyance portion 47 changes an attitude of the inner sheet bundle stacked on the stack tray 41 from a substantially horizontal attitude to a vertical attitude. Then, the grip conveyance portion 47 sets the inner sheet bundle at the adhesive applying position E so that the inner sheet bundle is placed along the bookbinding passage 33 arranged so as to extend in a substantially vertical direction.

(Adhesive Applying Portion 55)

Figure 3A:
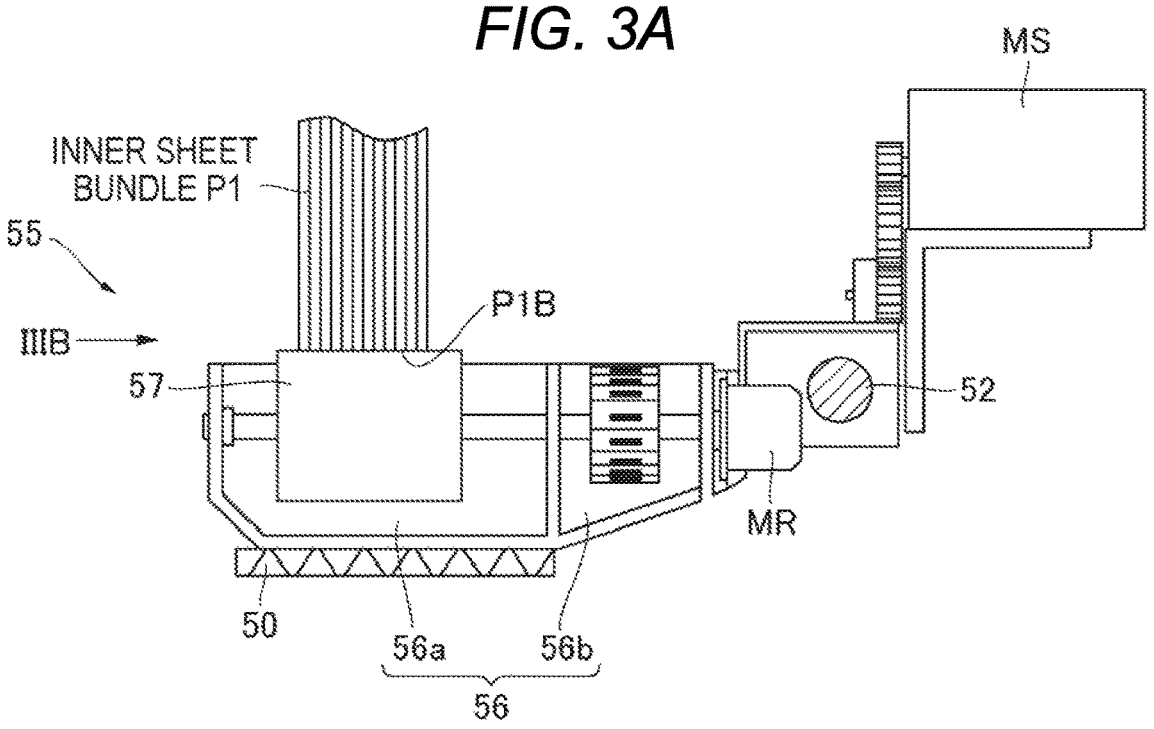
FIG. 3A is a front view for illustrating an adhesive applying portion of the bookbinding apparatus of FIG. 2.
Figure 3B:
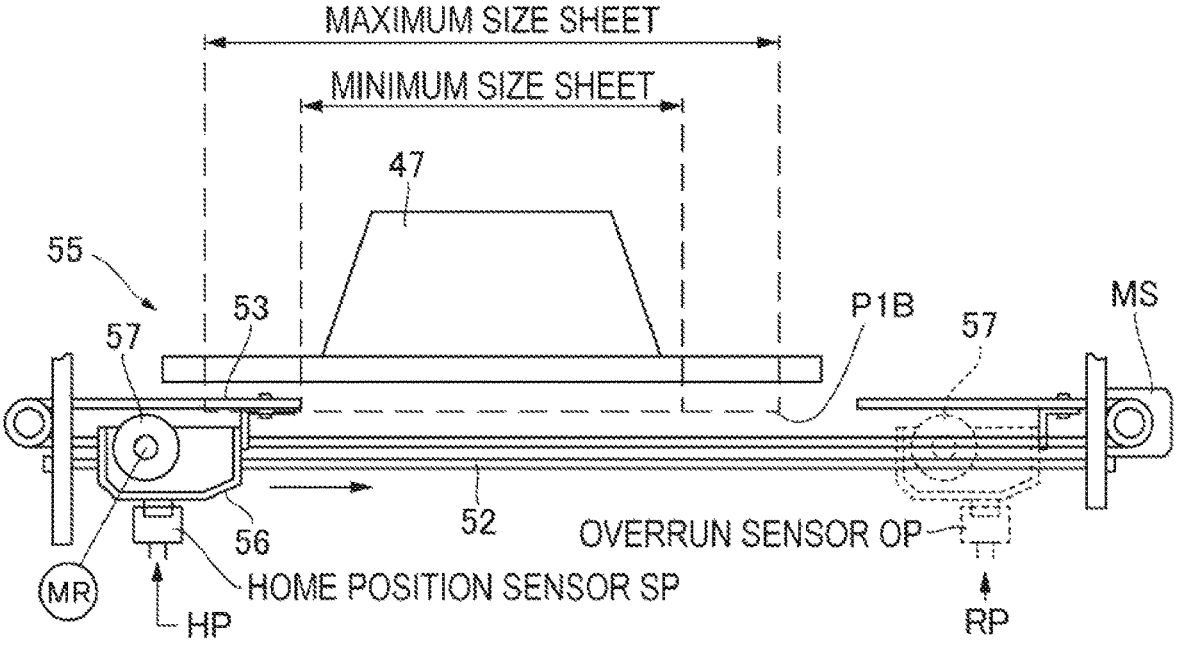
FIG. 3B is a view as seen in a direction indicated by the arrow IIIB of FIG. 3A.
Figure 24:
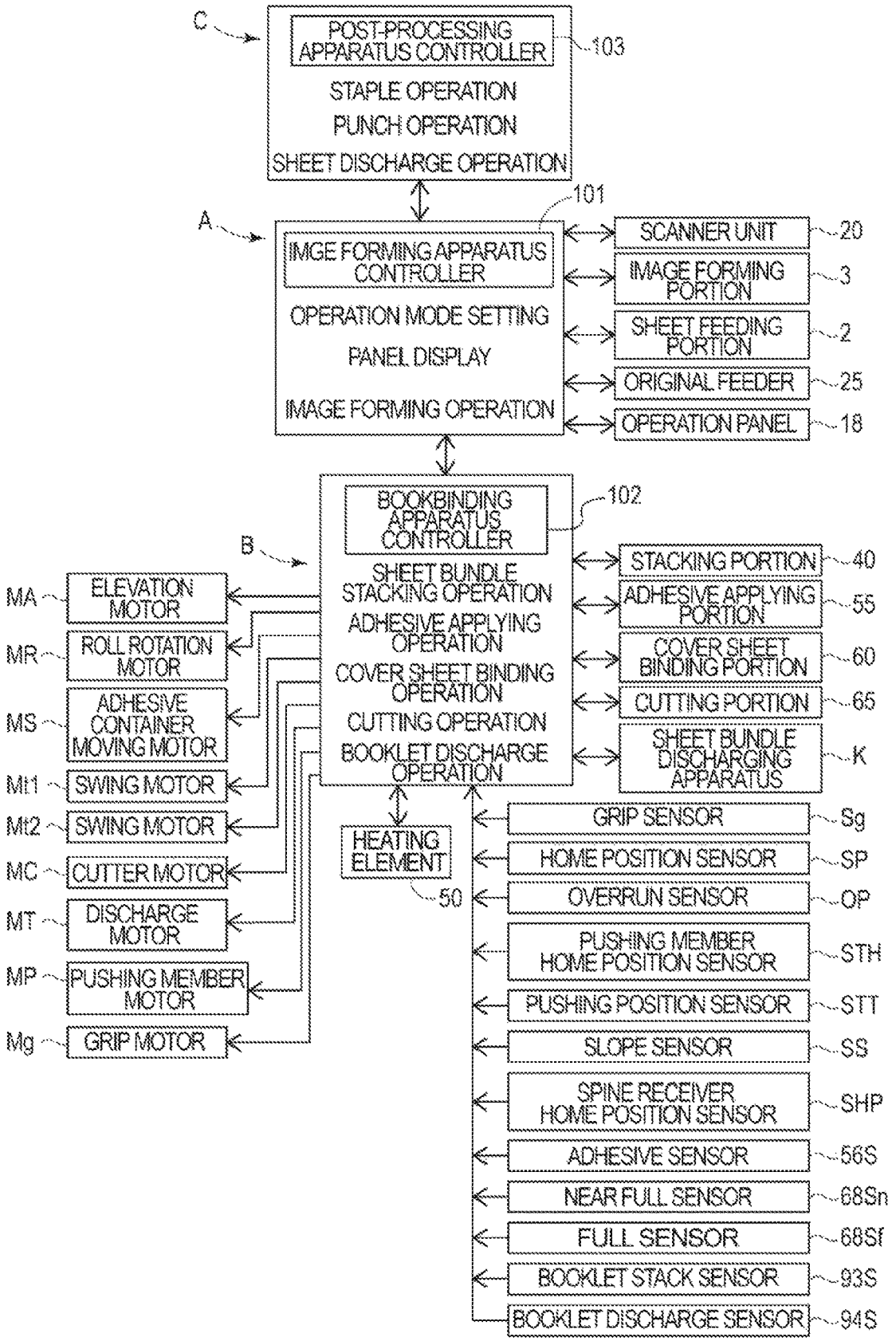
FIG. 24 is a control block diagram for illustrating the image forming system.

FIG. 3A and FIG. 3B are views for illustrating the adhesive applying portion 55. FIG. 3A is a front view. FIG. 3B is a view as seen in a direction indicated by the arrow IIIB of FIG. 3A. In FIG. 2, FIG. 3A, and FIG. 3B, the adhesive applying portion 55 is arranged at the adhesive applying position E on the bookbinding passage 33. The adhesive applying portion 55 includes, for example, an adhesive container 56, an applying roll 57, and a roll rotation motor MR. The adhesive container 56 is configured to accommodate a thermally meltable adhesive. The adhesive container 56 includes a liquid adhesive accommodating chamber 56*a* and a solid adhesive accommodating chamber 56*b*. The applying roll 57 is rotatably incorporated into the liquid adhesive accommodating chamber 56*a*. An adhesive sensor 56*s* (FIG. 2) configured to detect a remaining amount of the adhesive is provided in the liquid adhesive accommodating chamber 56*a*. The adhesive sensor 56*s* serves also as a temperature sensor configured to detect a temperature of the adhesive. That is, the adhesive sensor 56*s* is configured to detect a temperature of the liquefied adhesive in the liquid adhesive accommodating chamber 56*a*, and at the same time, detect a remaining amount of the adhesive based on a temperature difference at a part soaked in the adhesive. Further, a heating element 50 such as an electrothermal heater is provided to the adhesive container 56. The adhesive sensor 56*s* and the heating element 50 are connected to a bookbinding apparatus controller 102 (FIG. 1 and FIG. 24). The bookbinding apparatus controller 102 is configured to adjust a temperature of the adhesive in the liquid adhesive accommodating chamber 56*a* to a predetermined melting temperature based on a detected temperature of the heating element 50. The applying roll 57 is formed of a heat-resistant porous material, and is configured to allow the adhesive to be impregnated thereinto to thereby allow a layer of the adhesive to bulge on a periphery of the roll.

The adhesive container 56 having the configuration as described above is driven to reciprocate along a back side of the inner sheet bundle. As illustrated in FIG. 3B, the adhesive container 56 is formed so as to have a length (dimension) shorter than a lower end edge (back cover sheet portion at the time of bookbinding) P1B of the inner sheet bundle, and is supported on a guide rail 52 of the casing 30 (FIG. 2) so as to be movable along the lower end edge P1B of the inner sheet bundle P1 together with the applying roll 57 provided inside the adhesive container 56. The adhesive container 56 is coupled to a timing belt 53, and an adhesive container moving motor MS is coupled to the timing belt 53.

The adhesive container 56 is guided by the guide rail 52 between a home position HP on the left side in FIG. 3B and a return position RP on the right side in FIG. 3B at which the returning operation along the sheet bundle is started, and is reciprocated by the adhesive container moving motor MS. The return position RP is set based on size information of a sheet width. The home position sensor SP detects that the adhesive container 56 is at the home position HP. The adhesive container 56 waits at the home position HP when an apparatus power supply is turned on (in an initial state). Then, the adhesive container 56 moves from the home position HP to the return position RP after elapse of a predetermined time (estimated time for the sheet bundle to arrive at the adhesive applying position E) from reception of a sheet grip signal of a grip sensor Sg (FIG. 2) provided to, for example, the preceding grip conveyance portion 47. A position of the adhesive container 56 can be detected by counting drive pulses of the adhesive container moving motor MS. An overrun sensor OP may be provided to the return position RP as illustrated in FIG. 3B, and overrun of the adhesive container 56 may be prevented based on the detection result of the overrun sensor OP. Simultaneously with the movement of the adhesive container 56 from the home position HP to the return position RP, the applying roll 57 starts rotation by the roll rotation motor MR. The adhesive applying portion 55 having such a configuration starts movement from the left side toward the right side in FIG. 3B through the rotation of the adhesive container moving motor MS and the guidance with the guide rail 52. On the forward passage, the applying roll 57 is held in pressure contact with the sheet bundle to loosen the end portion of the sheet bundle. Further, on the return path for returning from the return position RP to the home position HP, an elevation motor (not shown) adjusts the delivery amount of the grip conveyance portion 47 so as to allow the applying roll 57 and the end portion of the sheet bundle to define a predetermined gap to apply the adhesive.

(Cover Sheet Binding Portion 60)

Figure 4:
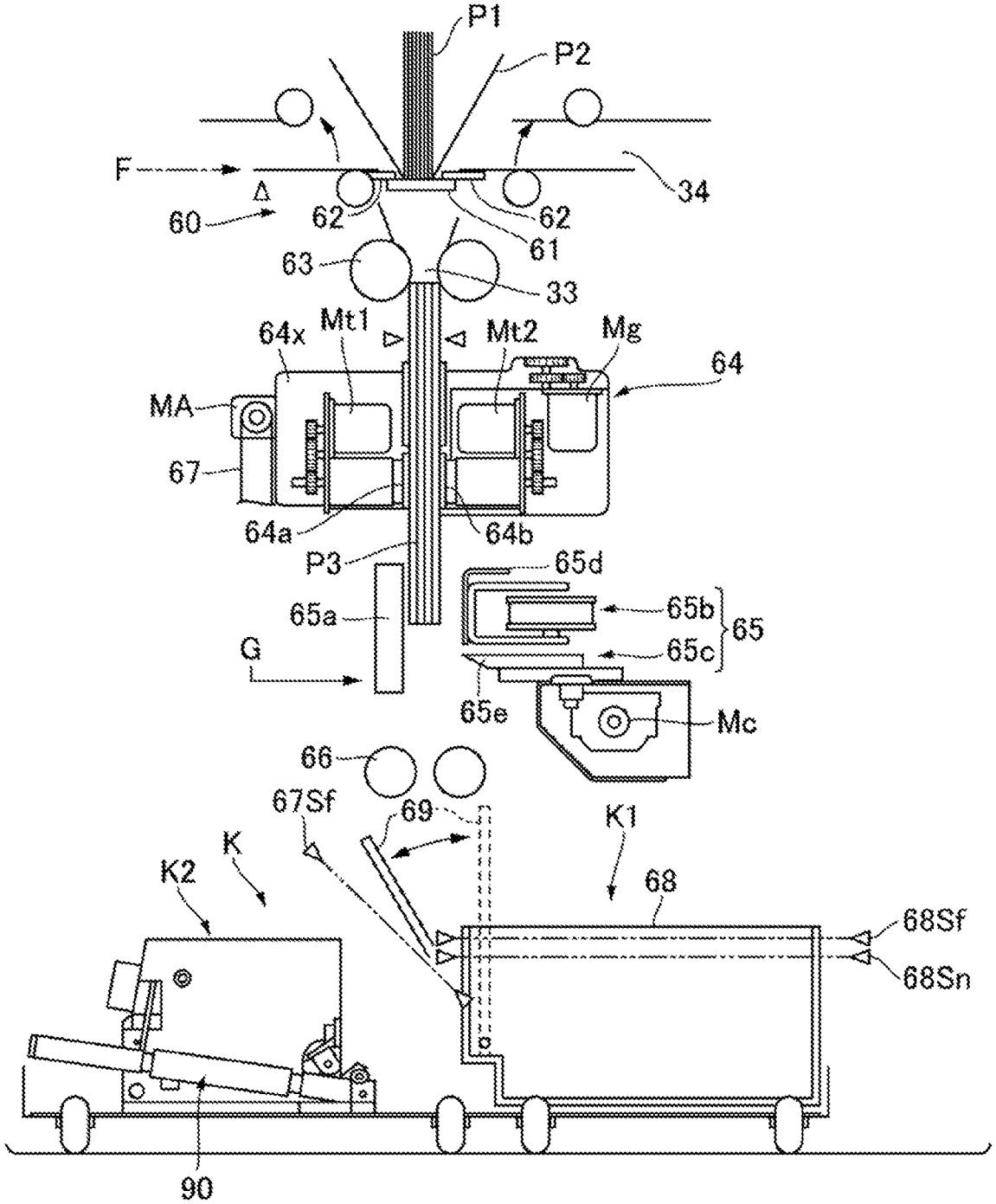
FIG. 4 is a view for illustrating a cover sheet binding portion, a bundle attitude deflecting portion, a cutting portion, and a discharging portion.

FIG. 4 is a view for illustrating the cover sheet binding portion 60, the bundle attitude deflecting portion 64, the cutting portion 65, and the sheet bundle discharging apparatus K. The cover sheet binding portion 60 is provided at a cover sheet binding position F on the bookbinding passage 33. The cover sheet binding portion 60 serving as a binding unit is formed of, for example, a spine contact plate 61, spine folding plates 62, and a folding roller pair 63. The cover sheet conveyance passage 34 is arranged at the cover sheet binding position F, and a cover sheet is fed from the image forming apparatus A or the inserter apparatus 26. The spine contact plate 61 is formed of a plate-shaped member configured to back up the cover sheet, and is arranged on the bookbinding passage 33 so as to be able to freely advance and retreat. A cover sheet P2 supported by the spine contact plate 61 and an inner sheet bundle P1 to be covered by the cover sheet P2 are joined to each other in a reversed T shape. The spine folding plates 62 are formed of a pair of right and left press members. In order to perform spine folding on a spine portion of the cover sheet joined in the reversed T shape, the spine folding plates 62 approach and separate from each other by a driving portion (not shown). The spine folding plates 62 approach each other to perform the spine folding on the spine portion of the cover sheet P2. The folding roller pair 63 sandwiches and pressurizes a sheet bundle P3 covered with the cover sheet, which is formed through the spine folding on the cover sheet P2, to finish the covering.

(Bundle Attitude Deflecting Portion 64 and Cutting Portion 65)

In FIG. 4, on the downstream side of the folding roller pair 63, there is arranged the bundle attitude deflecting portion 64 configured to deflect a sheet bundle covered with a cover sheet in a top-and-base direction. At a cutting position G on the downstream side of the bundle attitude deflecting portion 64, there is provided the cutting portion 65 configured to cut a peripheral edge of a sheet bundle covered with a cover sheet. The bundle attitude deflecting portion 64 is configured to deflect the sheet bundle P3 covered with the cover sheet in a predetermined direction (attitude) from the cover sheet binding position E (FIG. 2) and feed the sheet bundle P3 to the cutting portion 65 or the sheet bundle discharging apparatus K on the downstream side. The cutting portion 65 is configured to trim a peripheral edge, which is a portion to be cut, of a sheet bundle covered with a cover sheet. Therefore, the bundle attitude deflecting portion 64 includes rotation tables 64*a* and 64*b* configured to grip and rotate the sheet bundle P3 covered with the cover sheet having been delivered from the folding roller pair 63. The rotation tables 64*a* and 64*b* are provided on a unit frame 64*x* mounted to the casing 30 (FIG. 2) so as to be able to be freely elevated. On the unit frame 64*x*, the pair of rotation tables 64*a* and 64*b* are arranged across the bookbinding passage 33 and are axially supported so as to be freely rotatable. One rotation table 64*b* is supported on the unit frame 64*x* so as to freely move in a thickness direction (direction orthogonal to the bookbinding passage 33) of the sheet bundle P3 covered with the cover sheet. Swing motors Mt1 and Mt2 configured to deflect an attitude of the sheet bundle P3 covered with the cover sheet in the bookbinding passage 33 are provided for the rotation tables 64*a* and 64*b*, respectively. Further, a grip motor Mg configured to move in a right-and-left direction in FIG. 4 is mounted to the rotation table 64*b* on the movable side. The unit frame 64*x* allows, with use of an elevation motor MA, the sheet bundle P3 covered with the cover sheet to be elevated along the bookbinding passage 33. The elevation motor MA is fixed to a fixing member (not shown). The elevation motor MA is configured to circulate a belt 67 coupled to the unit frame 64*x*, to thereby allow the unit frame 64*x* to be elevated.

The sheet bundle P3 covered with the cover sheet having been guided into the bookbinding passage 33 is gripped by the pair of left and right rotation tables 64*a* and 64*b* and is deflected in the attitude direction by the swing motors Mt1 and Mt2. The rotation tables 64*a* and 64*b* are capable of rotating the sheet bundle P3 covered with the cover sheet, which has been conveyed with the spine portion arranged on a lower side, by 180 degrees and delivering the sheet bundle P3 to the sheet bundle discharging roller pair 66 on the downstream side with a fore edge portion arranged on the lower side. Moreover, the rotation tables 64*a* and 64*b* are capable of rotating the sheet bundle P3 covered with the cover sheet sequentially by 90 degrees to deflect a top portion, a base portion, and a fore edge portion of the sheet bundle P3 downward to the cutting position G on the downstream side, thereby enabling the trim cutting of cutting peripheral edges on the three sides of the sheet bundle P3 covered with the cover sheet. A grip sensor (not shown) is provided to the rotation table 64*b* on the movable side. The grip sensor detects that the sheet bundle P3 covered with the cover sheet is reliably gripped between the left and right rotation tables 64*a* and 64*b*. After the detection, the rotation tables 64*a* and 64*b* are driven to rotate.

(Cutting Portion 65)

In FIG. 4, the cutting portion 65 is arranged on the downstream side of the bundle attitude deflecting portion 64. The cutting portion 65 includes, for example, a blade receiving member 65*a*, a cut edge pressing unit 65*b*, and a cutting blade unit 65*c*. The cut edge pressing unit 65*b* is configured to press and hold a cut edge of the sheet bundle P3 covered with the cover sheet against the blade receiving member 65*a*. The cutting blade unit 65*c* is configured to cut the cut edge. The cut edge pressing unit 65*b* is arranged at a position opposed to the blade receiving member 65*a* arranged on the bookbinding passage 33. The cut edge pressing unit 65*b* includes a pressurizing member 65*d* configured to be driven by a driving portion (not shown) to move in a direction perpendicular to the sheet bundle P3 covered with the cover sheet. The cutting blade unit 65*c* includes a cutting blade 65*e* and a cutter motor MC. The cutting blade 65*e* has a flat blade shape. The cutter motor MC is configured to drive the cutting blade 65*e*. The cutting portion 65 having such a configuration is configured to cut and trim a predetermined amount of a peripheral edge (cut edge) excluding the spine portion of the sheet bundle P3 covered with the cover sheet.

(Sheet Bundle Discharging Apparatus K)

As illustrated in FIG. 4, the sheet bundle discharging apparatus K is arranged below the cutting position G, and includes, for example, a cutting scrap collecting portion K1 and a sheet bundle discharging portion K2.

(Cutting Scrap Collecting Portion K1)

As illustrated in FIG. 4, the cutting scrap collecting portion K1 includes, for example, a sweeper portion 69, a cutting scrap collecting container 68, a full sensor 68Sf, and a near full sensor 68Sn, and is configured to accommodate a cutting scrap cut by the cutting blade 65*e*.

The sweeper portion 69 is provided immediately below the cutting position G. The sweeper portion 69 is driven by a driving motor (not shown) to rotate between a position indicated by the solid lines and a position indicated by the broken lines in FIG. 4. When the cutting portion 65 cuts the cut edge of the sheet bundle covered with the cover sheet, the sweeper portion 69 waits in an inclined state at the position indicated by the solid lines for receiving the cutting scrap formed by the cutting. As illustrated in FIG. 2, the sweeper portion 69 and a discharging guide 71 described later are each formed into a comb-teeth shape so as not to interfere with each other when the sweeper portion 69 rotates.

As illustrated in FIG. 4, the sweeper portion 69 waiting at the position indicated by the solid lines receives the cutting scrap, which is formed in the cutting portion 65 and falls through the sheet bundle discharging roller pair 66, and guides the cutting scrap into the cutting scrap collecting container 68 through use of the inclination. On this occasion, the sheet bundle covered with the cover sheet is held by the rotation tables 64*a* and 64*b* and hence do not fall. When the cutting processing by the cutting portion 65 on the sheet bundle covered with the cover sheet is terminated, the sweeper portion 69 rotates to the position indicated by the broken lines, which is a position avoiding the location directly below the sheet bundle discharging roller pair 66 and is close to the cutting scrap collecting container 68. As a result, the sweeper portion 69 does not hinder falling of the booklet, which is released from being held by the rotation tables 64*a* and 64*b* and is discharged from the sheet bundle discharging roller pair 66. The booklet falls onto the sheet bundle discharging portion K2.

When a certain amount of the cutting scrap has been collected to the cutting scrap collecting container 68, the near full sensor 68Sn detects that the cutting scrap collecting container 68 is nearly filled. When the near full sensor 68Sn performs the operation of detecting that the cutting scrap collecting container 68 is nearly filled, the bookbinding apparatus controller 102 (FIG. 24) notifies the image forming apparatus controller 101 of that fact. The image forming apparatus controller 101 displays, on an operation panel 18 (FIG. 1 and FIG. 24) of the image forming apparatus A that the cutting scrap collecting container 68 is nearly filled. The near full sensor 68Sn is arranged such that, in order to prevent the cutting scrap collecting container 68 from being fully filled during cutting of a sheet bundle covered with a cover sheet, for example, the cutting scrap can be detected under a state in which the cutting scrap of the amount corresponding to one time of cutting of a peripheral edge of a sheet bundle covered with a cover sheet can be accommodated. When the cutting scrap collecting container 68 is fully filled with the cutting scrap, the full sensor 68Sf displays on the operation panel 18 that the cutting scrap collecting container 68 is fully filled with the cutting scrap, and also performs display of prompting disposal of the cutting scrap.

(Sheet Bundle Discharging Portion K2)

Figure 5:
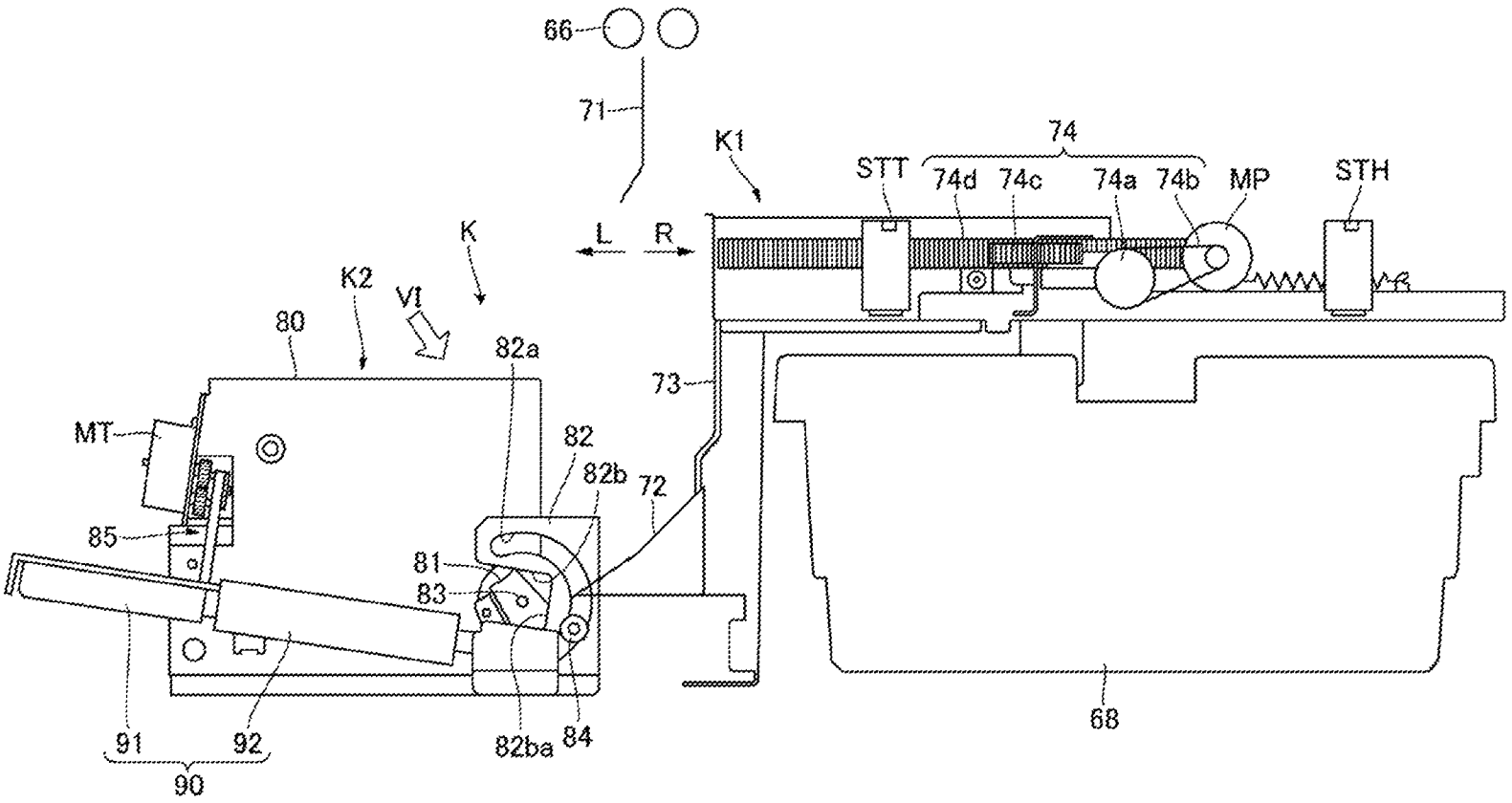
FIG. 5 is a schematic view for illustrating a sheet bundle discharging apparatus according to the embodiment of the present invention, and is an illustration of a state in which a spine receiver waits at a position for receiving a booklet.
Figure 6:
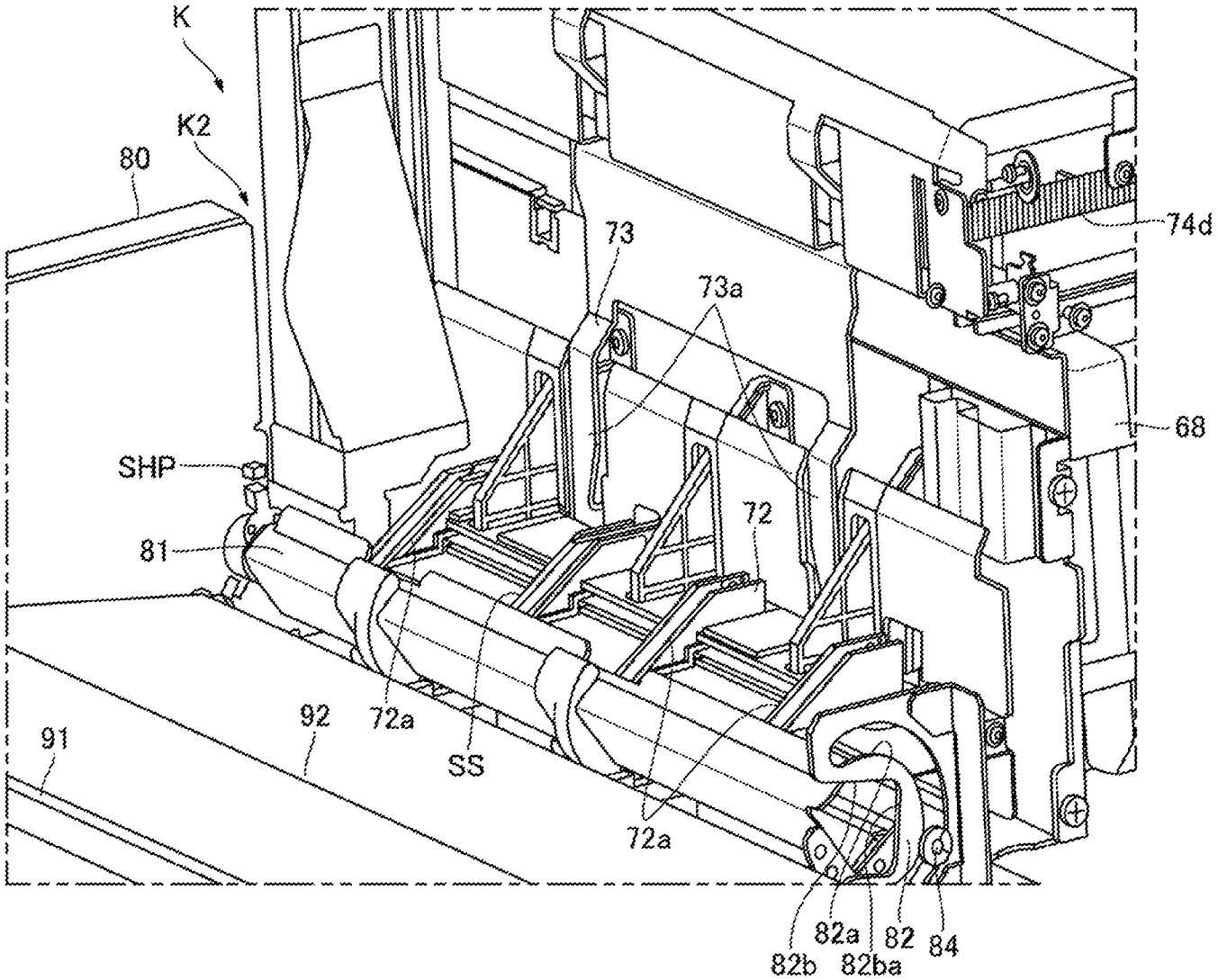
FIG. 6 is a view as seen in a direction indicated by the arrow VI of FIG. 5.

FIG. 5 is a schematic view for illustrating the sheet bundle discharging apparatus K, and is an illustration of a state in which a spine receiver 81 waits at a position for receiving a booklet. FIG. 6 is a view as seen in a direction indicated by the arrow VI of FIG. 5. In FIG. 1, FIG. 2, and FIG. 4, the sheet bundle discharging portion K2 is arranged on a lower side (on downstream) with respect to the sheet bundle discharging roller pair 66 and the discharging guide 71. In FIG. 5 and FIG. 6, the sheet bundle discharging portion K2 is formed of, for example, a pushing member (pushing unit) 73, a slope 72, the spine receiver 81, a sheet bundle delivery portion 90, a spine receiver home position sensor SHP (FIG. 6), a slope sensor SS (FIG. 6), a pushing member home position sensor STH (FIG. 5), and a pushing position sensor STT (FIG. 5).

The pushing member 73 is provided on an upper part of the cutting scrap collecting container 68. The pushing member 73 is provided on the upper part of the cutting scrap collecting container 68 so as to be freely reciprocable by a pushing member driving portion 74 in directions (directions indicated by the arrows L and R) perpendicular to a direction in which the booklet falls from the sheet bundle discharging roller pair 66. The pushing member driving portion 74 includes, for example, a pushing member motor MP, a pulley 74*a*, a belt 74*b*, a pinion 74*c*, and a rack 74*d*. The pushing member motor MP is provided on the upper part of the cutting scrap collecting container 68. The belt 74*b* is stretched around the pushing member motor MP and the pulley 74*a*. The pinion 74*c* is in rotation conjugation with the pulley 74*a* through intermediation of a gear mechanism (not shown). The rack 74*d* is provided to the pushing member 73 so as to extend in a longitudinal direction of the pushing member 73 and is held in mesh with the pinion 74*c*. The pushing member driving portion 74 is configured to transmit a rotary force of the pushing member motor MP to the pinion 74*c* through the belt 74*b* and the pulley 74*a*, to thereby allow the pushing member 73 to reciprocate integrally with the rack 74*d* in the directions indicated by the arrows L and R. The pushing member 73 and the pushing member driving portion 74 form laying means.

Figure 7:
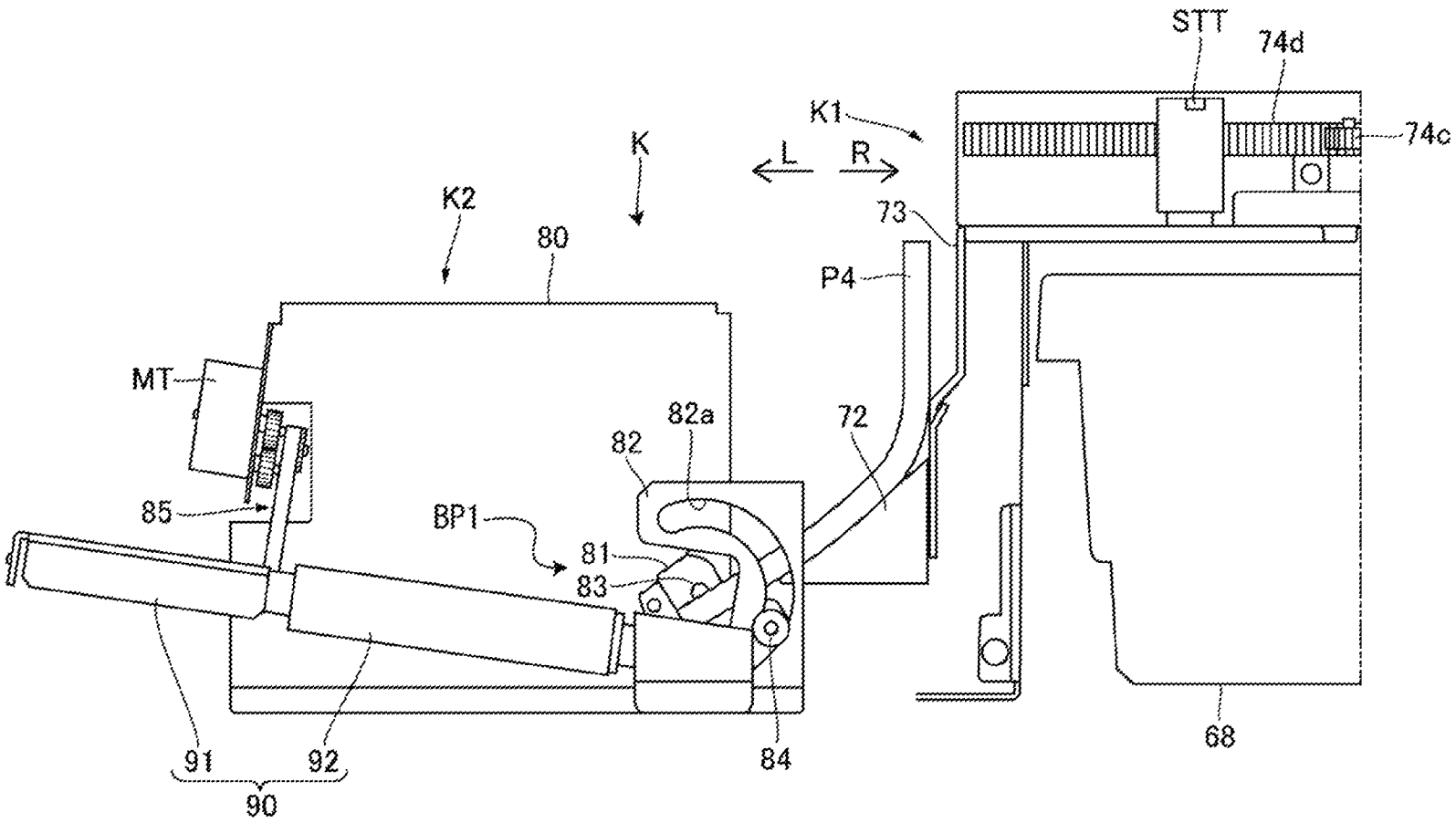
FIG. 7 is a view for illustrating a state in which, in the sheet bundle discharging apparatus of FIG. 5, the spine receiver receives the booklet at a booklet receiving position (waiting position).
Figure 8:
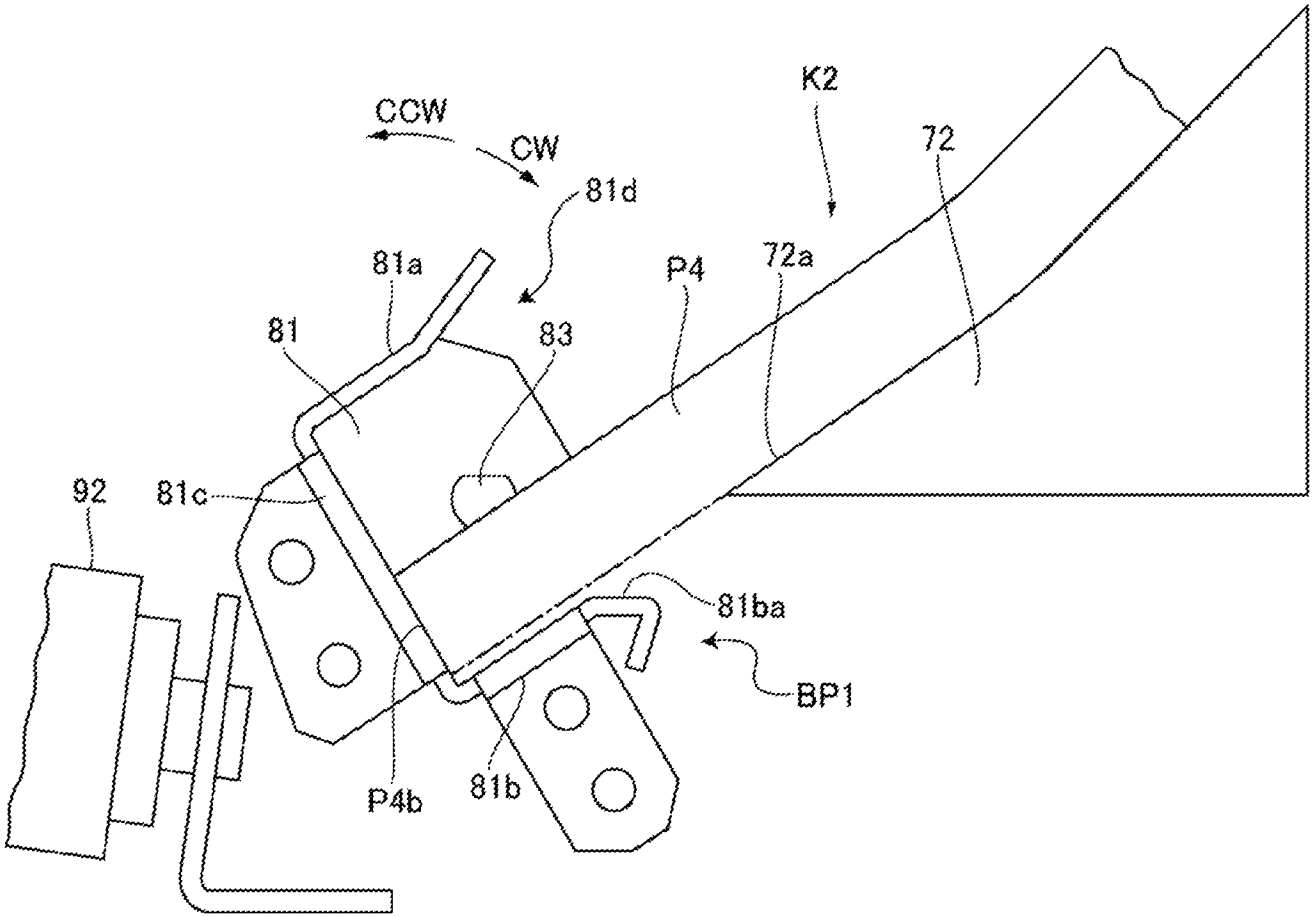
FIG. 8 is an enlarged view for illustrating a portion of the spine receiver of FIG. 7.

FIG. 7 is a view for illustrating a state in which, in the sheet bundle discharging apparatus K of FIG. 5, the spine receiver 81 receives a booklet P4 at a booklet receiving position (waiting position, first position). FIG. 8 is an enlarged view for illustrating a portion of the spine receiver 81 of FIG. 7. In FIG. 7 and FIG. 8, on a frame 80 of the sheet bundle discharging portion K2, the spine receiver 81 having a substantially U-shaped cross section is provided so as to reciprocally rotate in the same directions (arrow CCW direction and arrow CW direction) as moving directions of the pushing member 73. The spine receiver 81 serving as the receiving unit receives a spine portion P4*b* being a downstream end portion of the booklet P4 in the conveyance direction, which has been conveyed, and then rotates to lay the booklet P4 on the conveyance belt 92. The conveyance belt 92 is a circulating endless belt. A support shaft 83 described later is provided so as to project on a far-side end portion of the spine receiver 81, and a guide shaft 84 is provided so as to project on a near-side end portion of the spine receiver 81. With the support shaft 83 being freely rotatably supported on the frame 80, the spine receiver 81 rotates in the arrow CCW direction and the arrow CW direction. The spine receiver (receiving unit) 81 is rotatable between the first position BP1 and a second position BP2.

The spine receiver (receiving unit) 81 is an elongated gutter-shaped member having a substantially U-shaped cross section, and is formed of a spine receiver bottom plate (contact portion) 81*c*, a spine receiver upper guide (regulating portion, third flat surface) 81*a*, and a spine receiver lower guide (pushing portion, second flat surface) 81*b*. The spine receiver bottom plate (contact portion) 81*c* receives the spine portion P4*b* of the booklet P4. The spine receiver upper guide 81*a* and the spine receiver lower guide 81*b* are adjacent to the spine receiver bottom plate 81*c* and are parallel to each other. That is, the spine receiver 81 includes the spine receiver bottom plate 81*c* with which a leading end portion of the booklet P4 (sheet bundle) in the moving direction is to be brought into contact, the spine receiver lower guide 81*b* formed integrally with the spine receiver bottom plate 81*c* and configured to push a first surface of the booklet P4, and the spine receiver upper guide 81*a* formed integrally with the spine receiver bottom plate 81*c* so as to be opposed to the spine receiver lower guide 81*b* and configured to regulate the movement of a second surface on a side opposite to the first surface of the booklet P4 when the spine receiver 81 is in the waiting position. The booklet P4 moves with the portion thereof corresponding to the spine (spine portion P4*b*) being located on a leading side, and the spine portion P4*b* is brought into contact with the spine receiver bottom plate 81*c*.

The spine receiver upper guide 81*a* and the spine receiver lower guide 81*b* are parallel to each other and are substantially perpendicular to the spine receiver bottom plate 81*c*. The spine receiver bottom plate (contact portion) 81*c* is a part with which the leading end portion (portion of the spine) of the booklet (sheet bundle) P4 in the moving direction, which is guided by the slope 72, is to be brought into contact. The spine receiver lower guide 81*b* (pushing portion) is formed integrally with the spine receiver bottom plate (contact portion) 81*c* and is configured to push the first surface of the booklet P4. The spine receiver upper guide (regulating portion) 81*a* is configured to regulate the movement of the second surface of the booklet P4 when the spine receiver (receiving unit) 81 is in the first position BP1. A direction of a rotation center line of the support shaft 83 is substantially parallel to a longitudinal direction of the spine receiver bottom plate (contact portion) 81*c*. The spine receiver 81 includes a receiving port 81*d* configured to receive the booklet P4 when the spine receiver 81 is in the first position BP1 as illustrated in FIG. 8. When the spine receiver 81 rotates from the first position BP1 to the second position BP2, the receiving port 81*d* approaches the sheet bundle delivery portion (discharging unit) 90. It is preferred that the spine receiver 81 be formed of a first flat surface serving as the spine receiver bottom plate (contact portion) 81*c*, a second flat surface serving as the spine receiver lower guide 81*b* (pushing portion), and a third flat surface serving as the spine receiver upper guide (regulating portion) 81*a*. The second flat surface and the third flat surface are adjacent to the first flat surface and are opposed to each other. The conveyance belt 92 includes an inclined surface that is inclined with respect to the horizontal direction. The inclined surface includes a first portion and a second portion that is located at a position lower than the first portion. The second portion is closer to the spine receiver 81 than the first portion in the horizontal direction.

Figure 9:
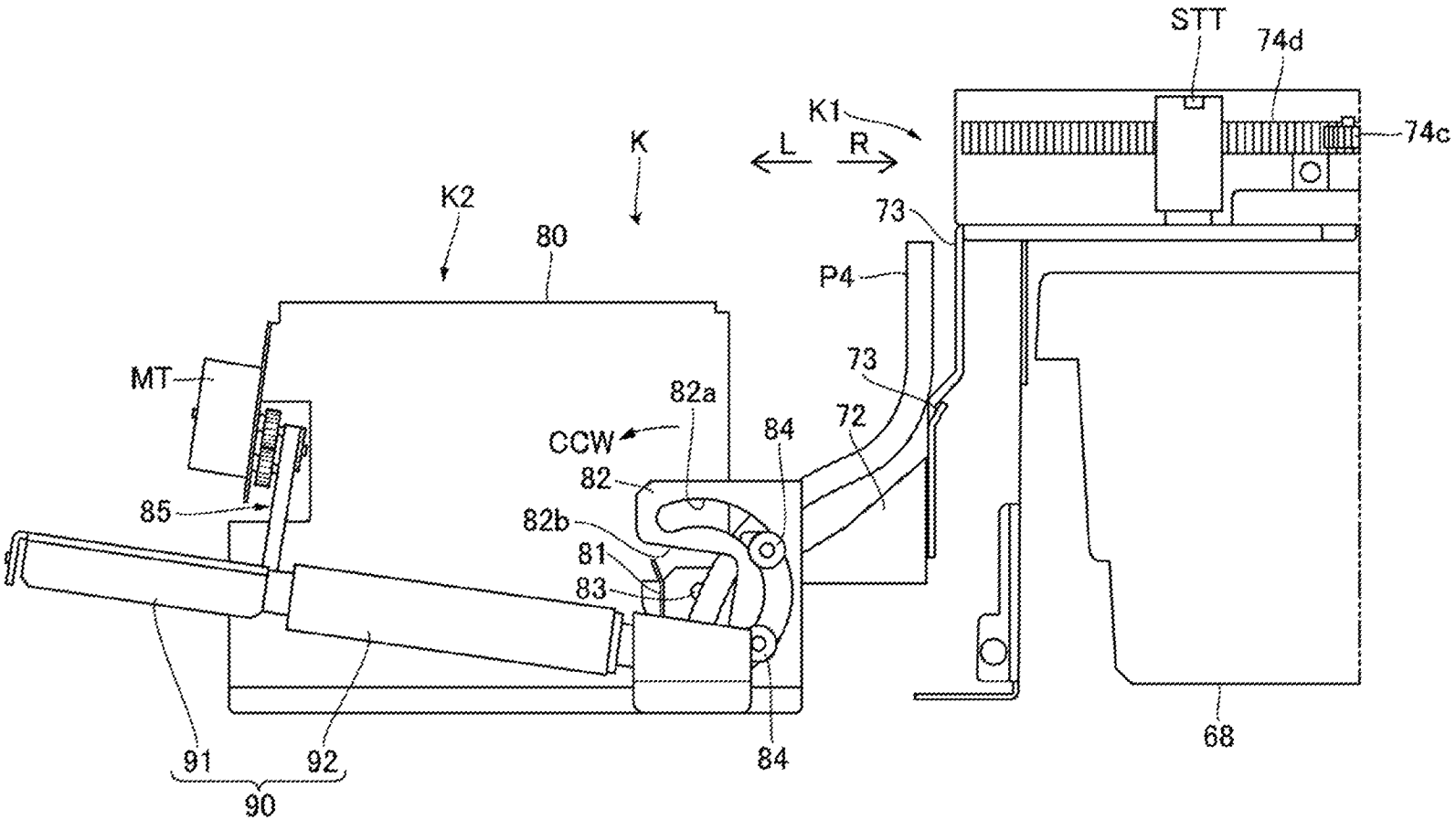
FIG. 9 is a view for illustrating a state in which the spine receiver of the sheet bundle discharging apparatus of FIG. 7 starts leftward rotation to discharge the booklet.
Figure 10:
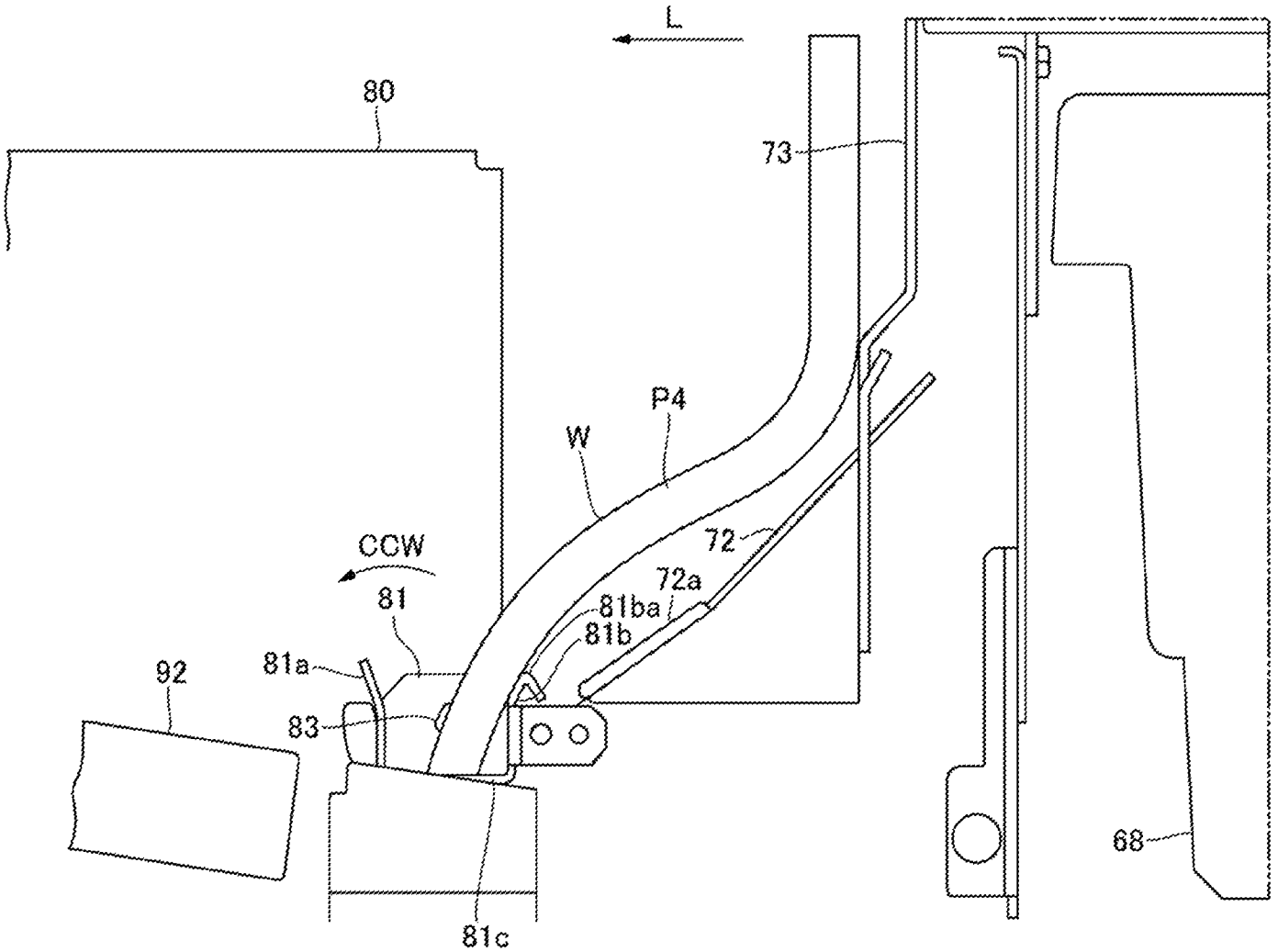
FIG. 10 is an enlarged view for illustrating a periphery of the spine receiver of FIG. 9.

FIG. 9 is a view for illustrating a state in which the spine receiver 81 of the sheet bundle discharging apparatus K of FIG. 7 starts rotation in the CCW direction to discharge the booklet P4. FIG. 10 is an enlarged view for illustrating a periphery of the spine receiver 81 of FIG. 9. In FIG. 9 and FIG. 10, a pair of guide shafts 84 are provided at a downstream end portion of the spine receiver 81 in the sheet bundle conveyance direction (arrow L direction) such that the pair of guide shafts 84 each project. The pair of guide shafts 84 are engaged with a guide hole 82*a* formed in a guide plate 82 provided to the frame 80. The guide hole 82*a* is formed as an arc-shaped elongated hole, and a center thereof is aligned with a center of the support shaft 83. The spine receiver 81 rotates about the support shaft 83, and the pair of guide shafts 84 also rotate about the same position as a center. The spine receiver 81 receives a rotary force from a discharge motor MT being a pulse motor through a rotary force transmitting mechanism 85 (partially not shown) so that the spine receiver 81 is rotatable from the booklet receiving position (waiting position, first position) detected by the spine receiver home position sensor SHP (FIG. 6) to a discharge position (laying position, second position) for discharging the booklet. The moving direction of the booklet as seen from above while the spine receiver 81 rotates from the booklet receiving position to the discharge position intersects with the moving direction of the booklet discharged by the sheet bundle delivery portion 90.

Figure 12:
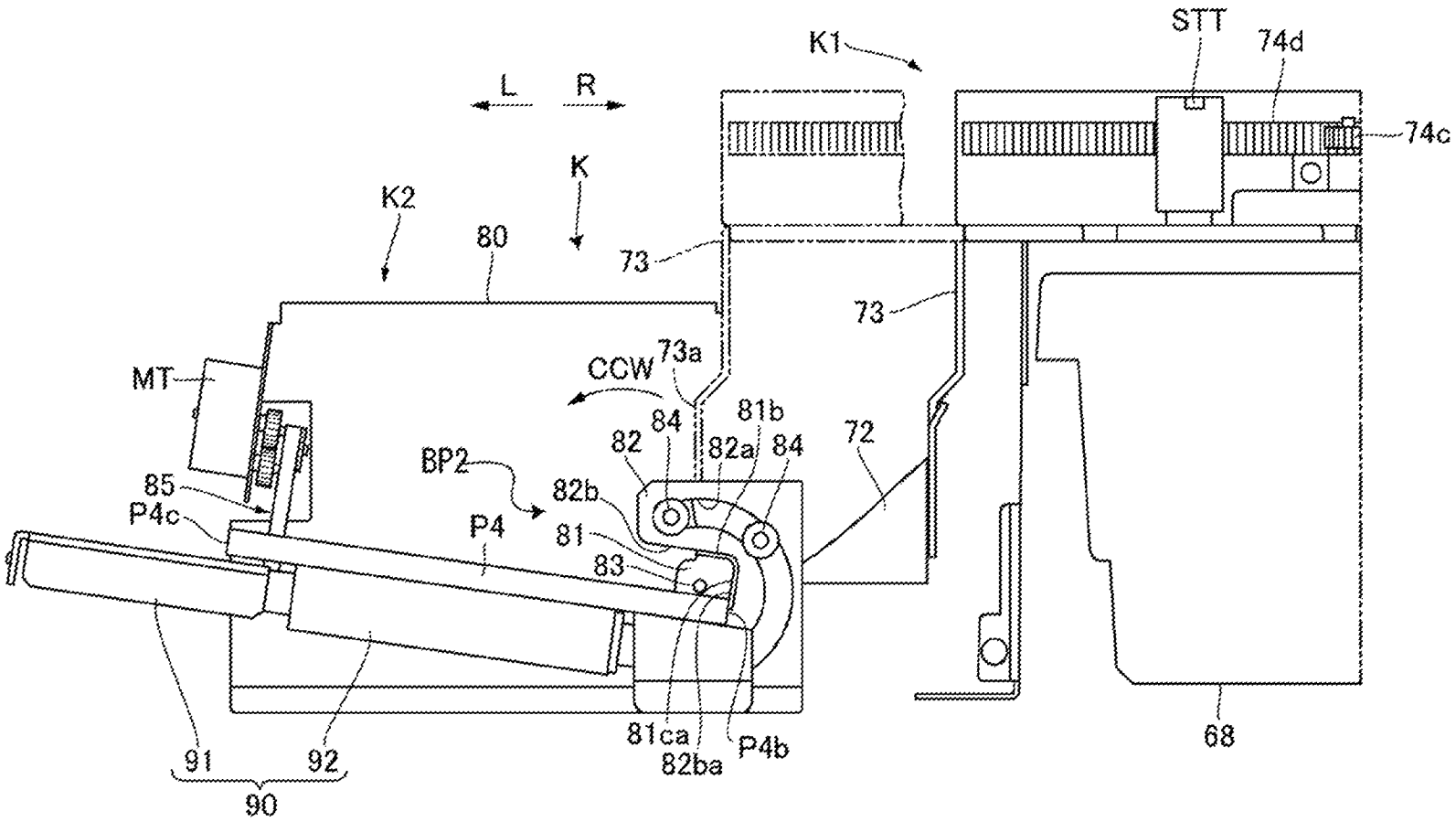
FIG. 12 is a view for illustrating a state in which the spine receiver further rotates leftward from the state of FIG. 11, and the pushing member further pushes the booklet in the conveyance direction in synchronization with the spine receiver, thereby laying the booklet on a conveyance belt.
Figure 22:
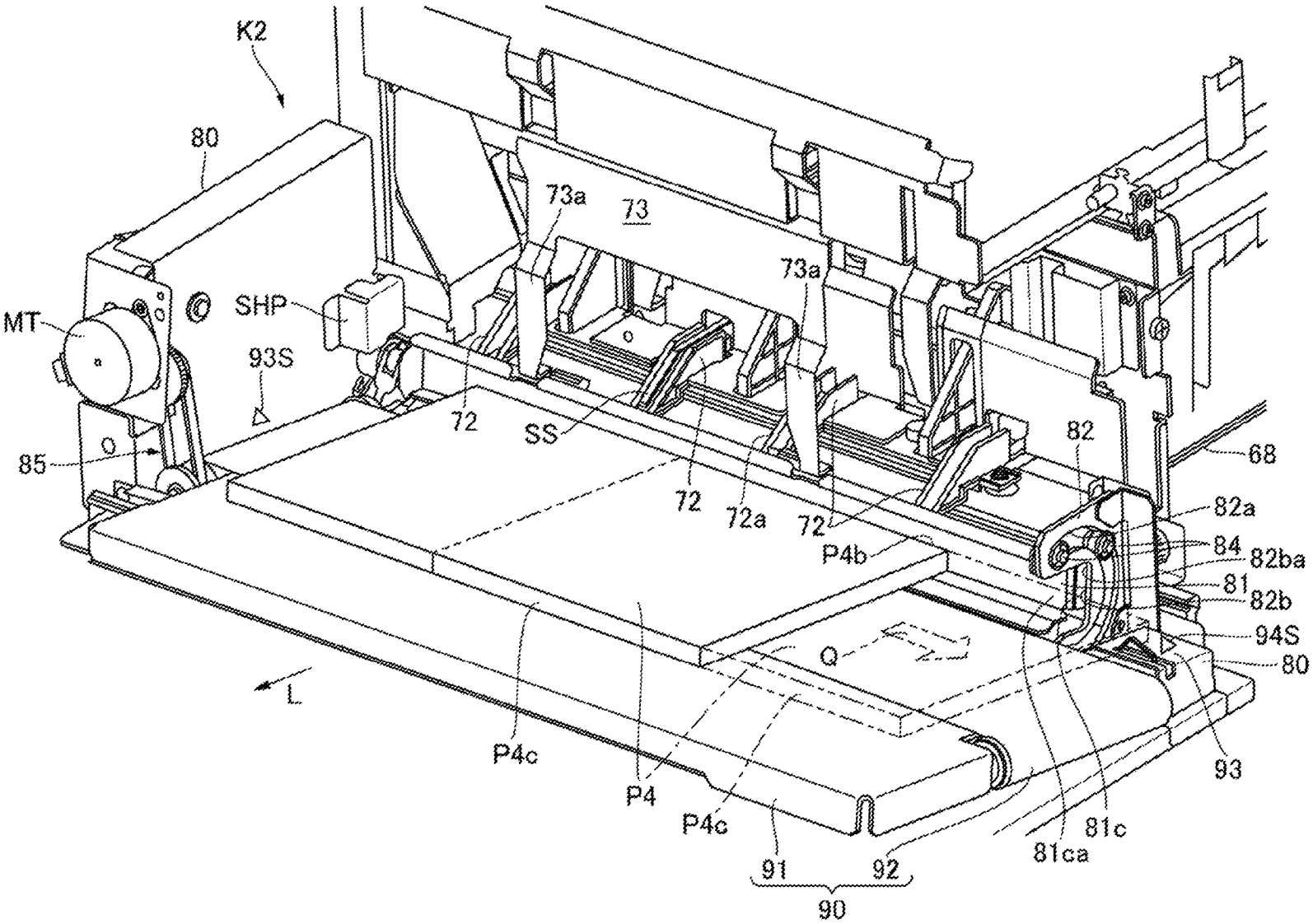
FIG. 22 is a perspective view for illustrating a state in which the conveyance belt delivers the booklet from the state of FIG. 12.

The guide plate 82 has a cutout 82*b* for allowing the booklet P4 to pass therethrough. The cutout 82*b* has a substantially U shape that is similar to the sectional shape of the spine receiver 81. As illustrated in FIG. 12 and FIG. 22, in a relative positional relationship between the guide plate 82 and the spine receiver 81, an orientation of the guide plate 82 and an orientation of the substantially U shape of the spine receiver 81 having rotated in the arrow CCW direction are substantially the same. In this embodiment, a far edge 82*ba* of the cutout 82*b* (FIG. 22) is formed on the upstream side in the sheet bundle conveyance direction (arrow L direction) with respect to a booklet receiving surface (flat surface) 81*ca* formed on a gutter-shaped inner surface on which the spine receiver bottom plate 81*c* of the spine receiver 81 receives the spine portion P4*b* of the booklet P4. This is for the purpose of avoiding the situation in which the booklet P4 interferes with the guide plate 82 so that the booklet P4 cannot be discharged to an outside of the sheet bundle discharging apparatus K.

Similarly, the support shaft 83 is provided also to the spine receiver 81 on the far side of the sheet bundle discharging apparatus K, and the pair of guide shafts 84 serving as support shafts are provided on the outer side of the gutter shape, without providing a rotary shaft or a support shaft in an inner region of the gutter shape through which the booklet P4 received at the spine receiver 81 on the near side of the sheet bundle discharging apparatus K passes. Accordingly, the interference between the pair of guide shafts 84 and the booklet P4, which is discharged by the conveyance belt 92 while being kept in the position of being laid, can be avoided.

When an attempt is to be made to avoid the interference between the booklet P4 and the guide plate 82 without forming the cutout 82*b* in the guide plate 82 and without arranging the pair of guide shafts 84 on the outer side of the gutter shape of the spine receiver 81, it is required that the conveyance belt 92 be rotated after laying the booklet P4 on the sheet bundle delivery portion 90 and then transferring the booklet P4 to the position of avoiding the guide plate 82 in the sheet bundle conveyance direction (arrow L direction) of FIG. 12. As a result, there arise problems in that the structure is complicated and that the discharge control for the booklet is complicated.

However, in the sheet bundle discharging apparatus according to this embodiment, the guide plate 82 is formed into the substantially U shape similar to the sectional shape of the spine receiver 81. Thus, when the spine receiver 81 is rotated to the discharge position (laying position), the booklet P4 can be discharged by rotating the conveyance belt 92 while the booklet P4 is kept in the position of being laid. Therefore, the sheet bundle discharging apparatus according to this embodiment has the feature that the booklet P4 can be promptly discharged with the simple structure.

The discharge motor MT is configured to rotate the spine receiver 81, and serves also as a drive source for circulating the conveyance belt 92 described later. The conveyance belt 92 and the spine receiver 81 are each connected to the discharge motor MT through intermediation of a one-way clutch (not shown). The conveyance belt 92 is driven by rotation of the discharge motor MT in a reverse direction, and the spine receiver 81 is connected to a link mechanism (not shown) configured to repeat swinging in the CCW direction and the CW direction in FIG. 8 through rotation of the discharge motor MT in a forward direction.

Further, a clutch (not shown) may be provided between the discharge motor MT and the spine receiver 81 and between the discharge motor MT and the conveyance belt 92, to thereby achieve a configuration of selectively transmitting the rotation of the discharge motor MT to each of the spine receiver 81 and the conveyance belt 92.

As illustrated in FIG. 5 and FIG. 6, the slope 72 serving as a guide unit is provided between the cutting scrap collecting container 68 and the spine receiver 81. The slope 72 is formed so that the spine receiver 81 side thereof has a downward slope. The slope 72 and the pushing member 73 are formed into a teeth shape with a gap therebetween so as to prevent interference with each other when the pushing member 73 moves.

FIG. 24 is a control block diagram for illustrating the image forming system in this embodiment. As illustrated in FIG. 24, the image forming apparatus controller 101 is provided to the image forming apparatus A. The image forming apparatus controller 101 controls the sheet supply portion 2, the image forming portion 3, the original feeder 25, and the scanner unit 20 based on image formation information input to the operation panel 18 by a user, to thereby allow the image forming apparatus A to perform an image forming operation. The bookbinding apparatus controller 102 is provided to the bookbinding apparatus B. The bookbinding apparatus controller 102 controls rotation of the motors through detection operations of the sensors to control the stacking portion 40, the adhesive applying portion 55, the cover sheet binding portion 60, the cutting portion 65, and the sheet bundle discharging apparatus K, to thereby allow the bookbinding apparatus B to perform a bookbinding operation. A post-processing apparatus controller 103 is provided to the post-processing apparatus C. The post-processing apparatus controller 103 controls the post-processing apparatus C to perform at least one post-processing such as stapling, punching, or center-binding on sheets having been subjected to image formation. The image forming apparatus controller 101, the bookbinding apparatus controller 102, and the post-processing apparatus controller 103 may be integrated and provided at any location in the image forming system D.

(Description of Booklet Discharging Operation)

Figure 23:
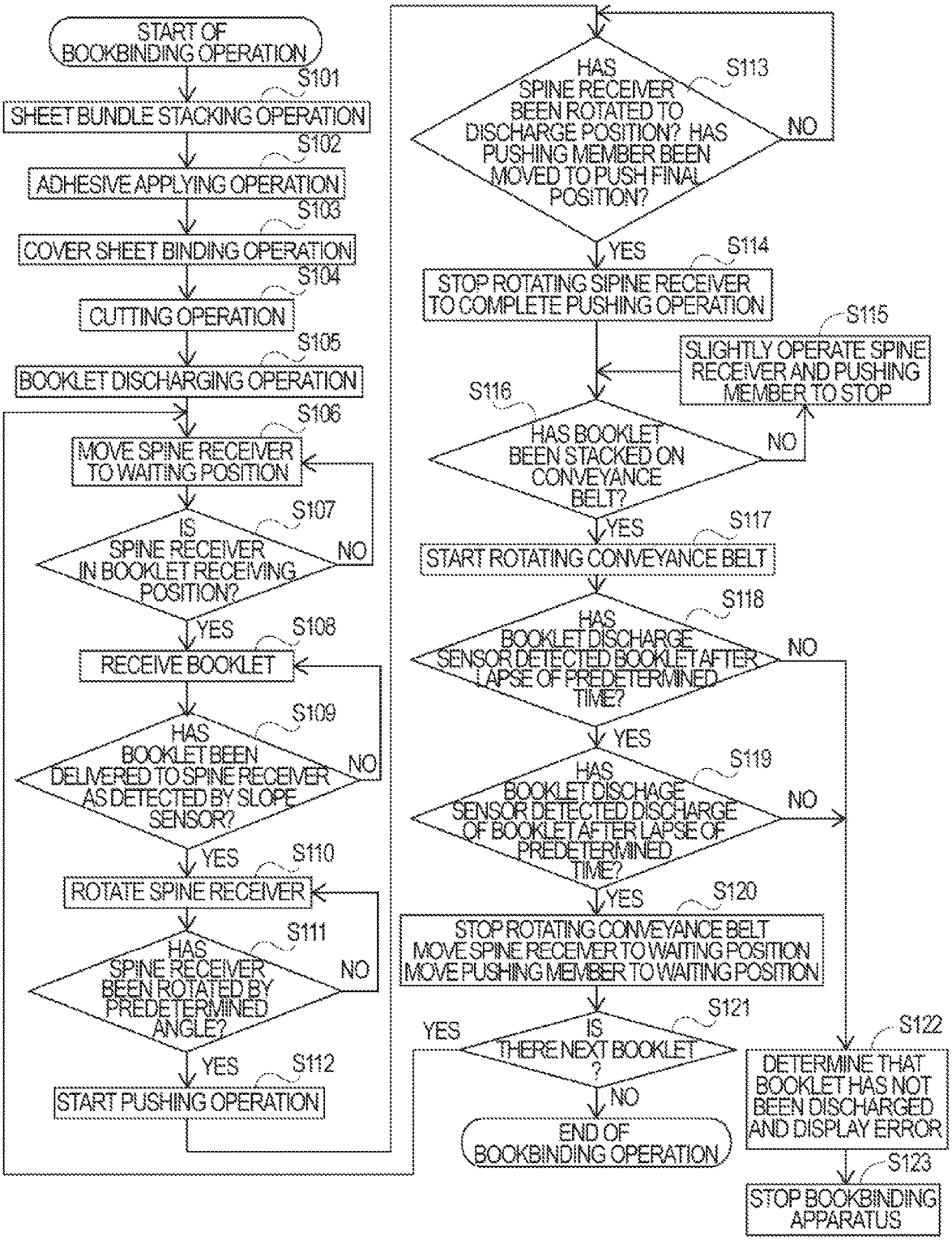
FIG. 23 is a flowchart for illustrating a bookbinding operation of the bookbinding apparatus according to this embodiment.

FIG. 23 is a flowchart for illustrating the bookbinding operation of the bookbinding apparatus B according to this embodiment. The flowchart is stored in a storage (not shown) of the bookbinding apparatus controller 102 in FIG. 1 and FIG. 24. The bookbinding apparatus controller 102 performs operation control for the bookbinding apparatus B based on the flowchart. On this occasion, the bookbinding apparatus controller 102 performs communication of information required for bookbinding with the image forming apparatus controller 101 and the post-processing apparatus controller 103.

Description is made of processing of Step S101 to Step S123 in FIG. 23. As illustrated in FIG. 2, FIG. 23, and FIG. 24, the inner sheet bundle having been stacked in the stacking portion 40 (FIG. 23, Step S101) is formed into the sheet bundle covered with the cover sheet by the adhesive applying portion 55 and the cover sheet binding portion 60 (Step S102 and Step S103). After that, the sheet bundle is subjected to trim-cutting in the cutting portion 65 to be formed into the booklet (Step S104). The sheet bundle discharging roller pair 66 starts the operation of discharging the booklet to the sheet bundle discharging portion K2 of the sheet bundle discharging apparatus K (Step S105). As illustrated in FIG. 5, at the time of receiving the booklet, it is required that the sheet bundle discharging portion K2 rotate the spine receiver 81 to the booklet receiving position (waiting position). Therefore, the bookbinding apparatus controller 102 allows the discharge motor MT to rotate, to thereby slightly rotate the spine receiver 81 in the rightward direction (FIG. 8, CW direction) (Step S106). The bookbinding apparatus controller 102 stops the discharge motor MT at the waiting position at which the spine receiver 81 is detected by the spine receiver home position sensor SHP (FIG. 6) (YES in Step S107).

Figure 11:
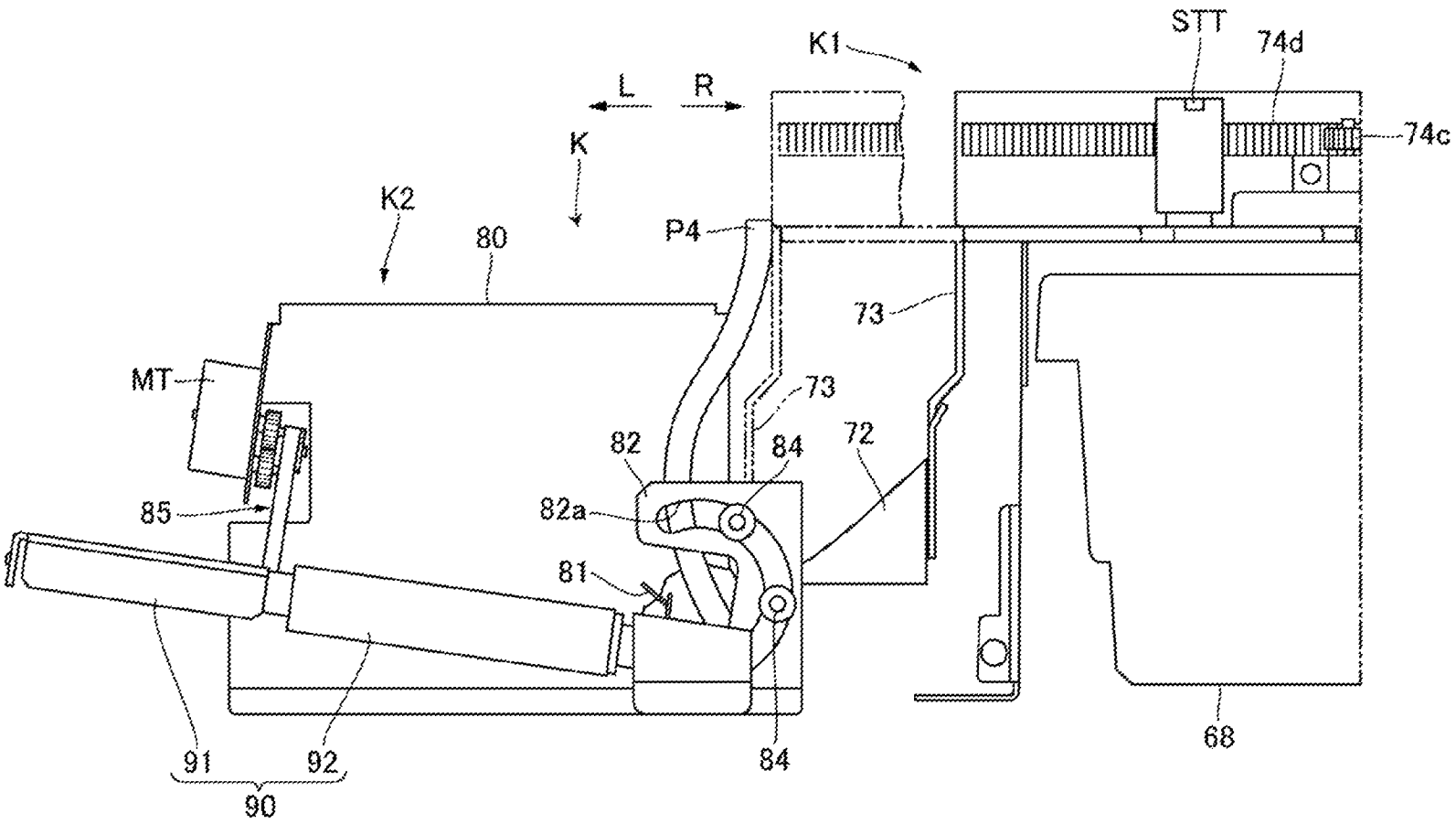
FIG. 11 is a view for illustrating a state in which the spine receiver further rotates leftward from the state of FIG. 7, and a pushing member pushes the booklet in a conveyance direction (arrow L direction) in synchronization with the spine receiver.

Then, when it is determined by the spine receiver home position sensor SHP that the spine receiver 81 is in the home position (waiting position), the booklet from the sheet bundle discharging roller pair 66 passes between the spine receiver upper guide 81*a* and the spine receiver lower guide 81*b*, with the receiving discharging guide 71 (FIG. 5) and the slope 72 serving as guides, and slides into the spine receiver 81. As illustrated in FIG. 7 and FIG. 8, the spine receiver 81 receives the spine portion P4*b* of the booklet P4 (Step S108). The bookbinding apparatus controller 102 determines whether or not the booklet has arrived at the spine receiver 81 based on the detection operation of the slope sensor SS illustrated in FIG. 6. When the booklet has arrived at the spine receiver 81 (YES in Step S109), the bookbinding apparatus controller 102 allows the discharge motor MT to reversely rotate, to thereby rotate the spine receiver 81 leftward in the CCW direction in FIG. 8 (Step S110). When the bookbinding apparatus controller 102 detects that a predetermined time has elapsed from start of rotation of the spine receiver 81 from the home position (or detects that the spine receiver 81 has rotated leftward to a predetermined angle) based on a pulse emitted from the discharge motor MT (YES in Step S111), the bookbinding apparatus controller 102 allows the pushing member motor MP (FIG. 5) to rotate, thereby allowing the pushing member 73 to start moving in the leftward direction (L direction) in FIG. 5. That is, the pushing member 73 starts operation after the start of rotation of the spine receiver 81. The pushing member 73 is located on the upstream side with respect to the spine receiver 81. The pushing member 73 starts operation and pushes (acts on) the booklet in synchronization with the spine receiver 81 at a position of the first surface of the booklet on the upstream side with respect to a position pushed by the spine receiver lower guide 81*b*, from the back of the booklet in the direction of laying the booklet on the conveyance belt 92 (L direction in FIG. 5) (Step S112). FIG. 11 is an illustration of this state. FIG. 11 is a view for illustrating a state in which the spine receiver 81 further rotates leftward from the state of FIG. 7, and the pushing member 73 pushes the booklet P4 in the conveyance direction (arrow L direction) in synchronization with the spine receiver 81.

Figure 13:
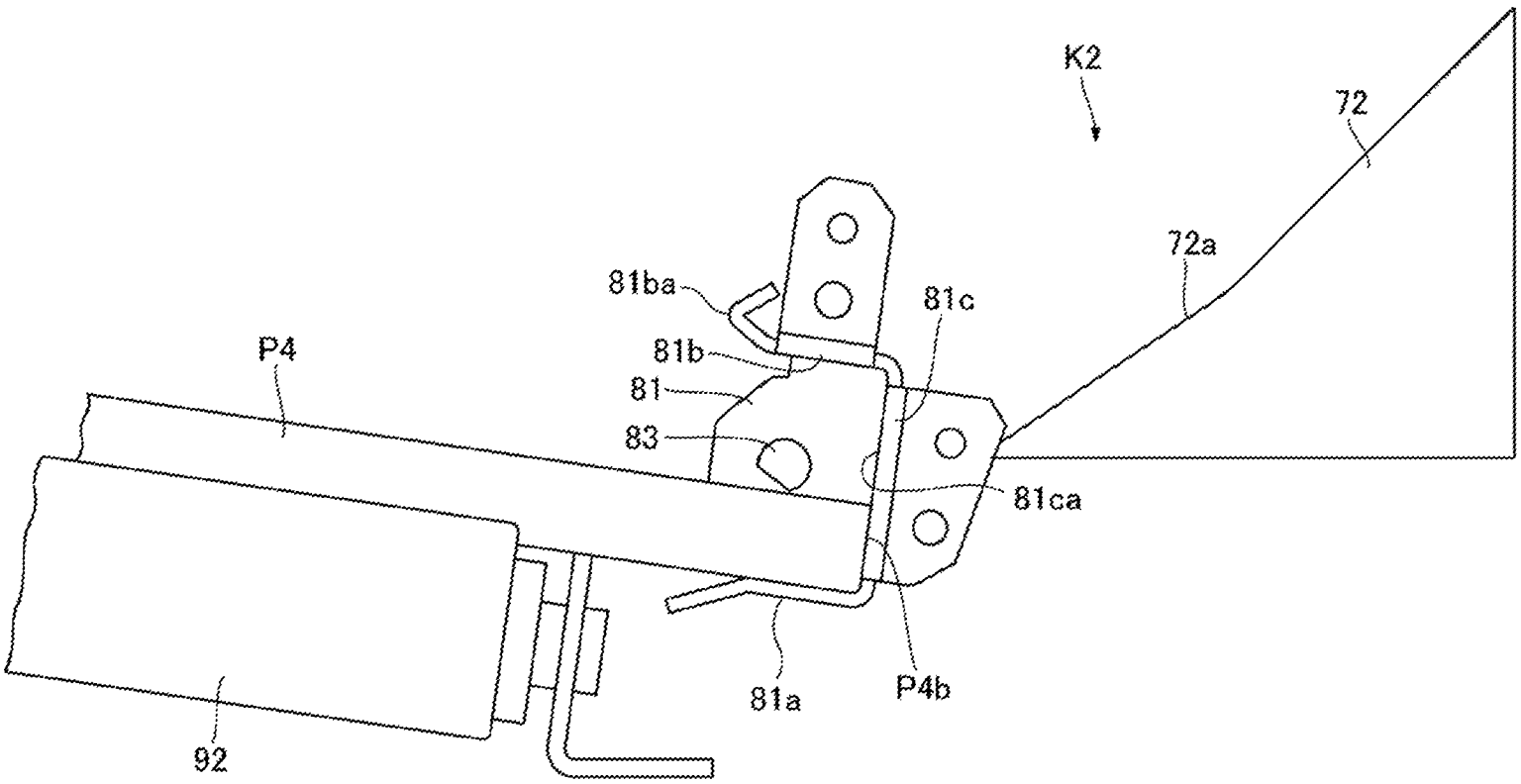
FIG. 13 is an enlarged view for illustrating a periphery of the spine receiver of FIG. 12.

FIG. 12 is a view for illustrating a state in which the spine receiver 81 further rotates leftward from the state of FIG. 11, and the pushing member 73 further pushes the booklet P4 in the conveyance direction (arrow L direction) in synchronization with the spine receiver 81, thereby laying the booklet P4 on the conveyance belt 92 (second position BP2). FIG. 13 is an enlarged view for illustrating a periphery of the spine receiver 81 of FIG. 12. In FIG. 12, FIG. 13, and FIG. 24, the bookbinding apparatus controller 102 detects that the spine receiver 81 has rotated the booklet leftward to the discharge position (laying position) with respect to the conveyance belt 92 based on a pulse emitted from the discharge motor MT. When the pushing position sensor STT detects that the pushing member 73 has moved to a push final position (YES in Step S113), the bookbinding apparatus controller 102 stops the rotation of the discharge motor MT and the pushing member motor MP (Step S114). After the rotation of the discharge motor MT and the pushing member motor MP has been stopped, when a booklet stack sensor 93S (FIG. 22) detects that the second surface of the booklet, that is, the surface opposite to the surface pushed by the spine receiver lower guide 81*b* is placed on the conveyance belt 92 so that the booklet is stacked (YES in Step S116), the bookbinding apparatus controller 102 allows the discharge motor MT to rotate, to thereby circulate the conveyance belt 92 (Step S117). The booklet stack sensor 93S is provided to the frame 80 near the conveyance belt 92 in FIG. 22. In the processing of Step S116, when the booklet is not detected by the booklet stack sensor 93S (NO in Step S116), the bookbinding apparatus controller 102 repeats the operation of slightly moving the spine receiver 81 and the pushing member 73 to stop (Step S115) until the booklet is detected (until YES is given in Step S116).

The booklet placement sensor 93S may be omitted, and circulation of the conveyance belt 92 may be start at a timing after elapse of a predetermined time from the stop of rotation of the pushing member motor MP.

It is preferred that a position at which the pushing member 73 pushes the booklet, that is, a position of the pushing member 73 projecting toward the booklet side be located at a plurality of positions including a part below the center in the height direction of the booklet and distributed at substantially equal distances from the center in the width direction of the booklet P4. With such positions, the booklet P4 is stabilized in behavior at the time of being laid on the conveyance belt 92, thereby being capable of reducing variation in position of the booklet P4 on the conveyance belt 92.

When a predetermined time has elapsed after circulation of the conveyance belt 92, and the booklet is detected by a booklet discharge sensor 94S (FIG. 22), the bookbinding apparatus controller 102 determines that the booklet has started being discharged (YES in Step S118). Further, when a predetermined time has elapsed, and the booklet is not detected by the booklet discharge sensor 94S (YES in Step S119), the bookbinding apparatus controller 102 determines that the booklet has been conveyed in the arrow Q direction and discharged to the outside of the sheet bundle discharging portion K2 (Step S120). The booklet discharge sensor 94S is provided on the frame 80 near a terminal end of the conveyance belt 92 as illustrated in FIG. 22. When the booklet has been discharged, the bookbinding apparatus controller 102 stops the conveyance belt 92, allows the discharge motor MT to return the spine receiver 81 to the waiting position, and allows the pushing member motor MP to return the pushing member 73 to the waiting position at which the pushing member 73 is detected by the pushing member home position sensor STH (FIG. 5). When the next booklet is present (YES in Step S121), the bookbinding apparatus controller 102 returns to the processing of Step S106, repeats the same control until the booklet becomes absent, and terminates the series of booklet discharging at the time point at which the booklet is absent (NO in Step S121).

When the booklet is not detected by the booklet discharge sensor 94S in the processing of Step S118 (NO in Step S118), or when the booklet remains being detected by the booklet discharge sensor 94S in the processing of Step S119 (NO in Step S119), the bookbinding apparatus controller 102 determines that the booklet is not placed at a predetermined position on the conveyance belt 92. Then, in the aim of preventing booklet jamming, the bookbinding apparatus controller 102 allows the operation panel 18 to display error (Step S122), and stops the conveyance belt 92 (Step S123).

As described above, in this embodiment, the spine receiver 81 receives and rotates the booklet, to thereby place the booklet on the sheet bundle delivery portion 90 and discharge the booklet to the outside with use of the sheet bundle delivery portion 90. Therefore, the booklet can be discharged to the outside of the apparatus without stopping the bookbinding operation. As a result, the productivity of the bookbinding can be improved.

(Detailed Description of Discharging Operation)

Among the processing of Step S101 to Step S123 in FIG. 23 described above, detailed description is made below with regard to the processing of Step S106 to Step S115, Step S108, and the processing of Step S119 to Step S123.

FIG. 7 and FIG. 8 are views for illustrating the state (first position BP1) in which the spine receiver 81 has received the booklet in the processing of Step S106, Step S107, and Step S108. As illustrated in FIG. 7 and FIG. 8, the spine receiver lower guide 81*b* of the spine receiver 81 is located substantially in parallel to a slope inclination surface 72*a* of the slope 72, and is located so as not to project upward (toward the booklet side) with respect to the slope inclination surface 72*a*. With this, the booklet P4 having been conveyed is reliably received by the spine receiver 81 without being caught by the spine receiver 81. Further, the spine receiver bottom plate 81*c* is formed so as to be substantially perpendicular to the spine receiver lower guide 81*b*. Thus, the spine receiver 81 receives the spine portion P4*b* of the booklet P4 in a close-contact state, thereby being capable of receiving the booklet in a stable attitude.

FIG. 9 and FIG. 10 are views for illustrating a state in which, in the processing of Step S110 and Step S111, after the spine receiver 81 has received the booklet P4 with the spine receiver bottom plate 81*c*, the discharge motor MT (FIG. 7) has rotated the spine receiver 81 in the counterclockwise direction (arrow CCW direction). In the processing of Step S110 and Step S111, the spine receiver 81 rotates in the counterclockwise direction (arrow CCW direction) by a predetermined angle, to thereby change the booklet into an attitude of being curved. That is, a distal end portion 81*ba* of the spine receiver lower guide 81*b* pushes the first surface of the booklet, and hence, as indicated by the reference symbol W in FIG. 10, a lower half portion of the booklet P4 is curved toward the rotation direction side of the spine receiver 81.

FIG. 11 is a view for illustrating the state of the spine receiver 81 and the pushing member 73 in the processing of Step S111 to Step S114. When the lower half portion of the booklet is curved as illustrated in FIG. 10, the pushing member motor MP (FIG. 5) rotates to move the pushing member 73 in the arrow L direction in FIG. 11 and bring the pushing member 73 into contact with the booklet. A position of the pushing member 73 is determined by the pushing member home position sensor STH (FIG. 5) and the pushing position sensor STT. When the spine receiver 81 receives the booklet, the pushing member 73 waits at the waiting position in FIG. 5 and FIG. 7 at which the pushing member 73 is detected by the pushing member home position sensor STH. Then, when the lower half portion of the booklet is curved as illustrated in FIG. 10, the pushing member 73 is brought into contact with the booklet (FIG. 11) while moving to a pushing operation completion position of FIG. 12 at which the pushing member 73 is detected by the pushing position sensor STT, and pushes down the booklet on the conveyance belt 92.

Figure 14:
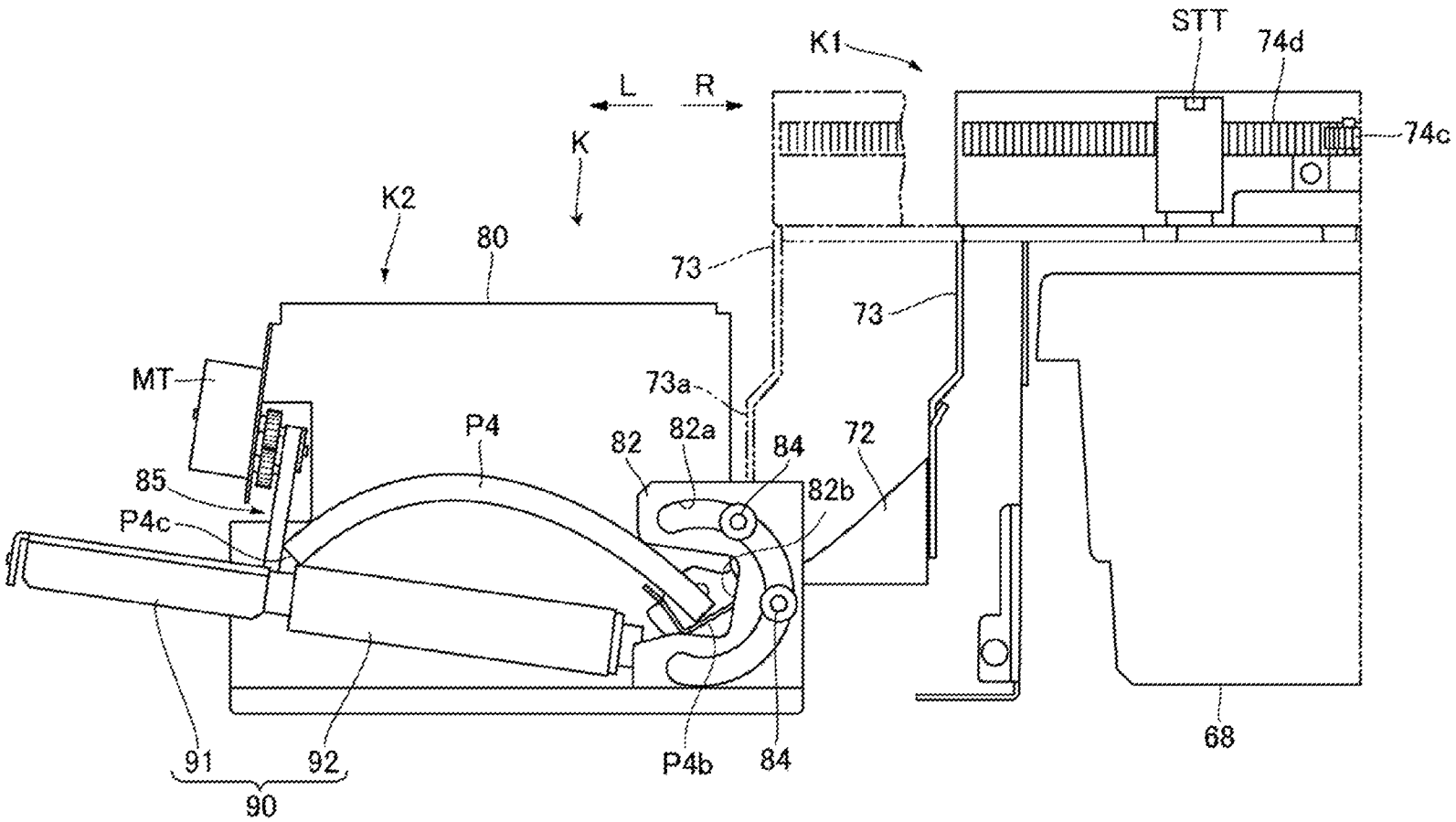
FIG. 14 is a view for illustrating a state in which, in the sheet bundle discharging apparatus of FIG. 7, when the rotating operation of the spine receiver is not performed, or when the rotating operation of the spine receiver and the pushing operation of the pushing member are not synchronized with each other, the booklet is curled on the conveyance belt.

In the description above, as illustrated in FIG. 9 and FIG. 10, the sheet bundle discharging portion K2 previously performs the rotating operation of the spine receiver 81 to allow the booklet P4 to be curved, and then starts the pushing operation of the pushing member 73, which is the operation of allowing the pushing member 73 to push the booklet, thereby pushing down the booklet on the conveyance belt 92. At the time of pushing down a booklet having a low stiffness or a large-sized booklet which has not been subjected to trim-cutting, when the operations of the spine receiver 81 and the pushing member 73 are not synchronized, in the course of pushing down the booklet, the fore edge side of the booklet is previously laid. Then, as illustrated in FIG. 14, the fore edge of the booklet is curled on the conveyance belt 92, and there is a risk of causing booklet jamming or causing a hitting mark or damage on the booklet surface. Further, the stiffness of the booklet and the size of the booklet are selected by a user, and hence, in many cases, what kind of the booklet is to be conveyed to the sheet bundle delivery portion 90 is unknown. Therefore, in order to allow the booklet to be reliably stacked on the conveyance belt 92 irrespective of a kind of the booklet to be conveyed, the sheet bundle discharging portion K2 of this embodiment synchronizes the rotating operation of the spine receiver 81 and the pushing operation of the pushing member 73 to prevent the risk of causing the booklet jamming or causing the hitting mark or damage on the booklet. FIG. 14 is a view for illustrating a state in which, in the sheet bundle discharging apparatus K of FIG. 7, when the rotating operation of the spine receiver 81 is not performed, or when the rotating operation of the spine receiver 81 and the pushing operation of the pushing member 73 are not synchronized, the booklet P4 is curled on the conveyance belt 92.

Figure 21:
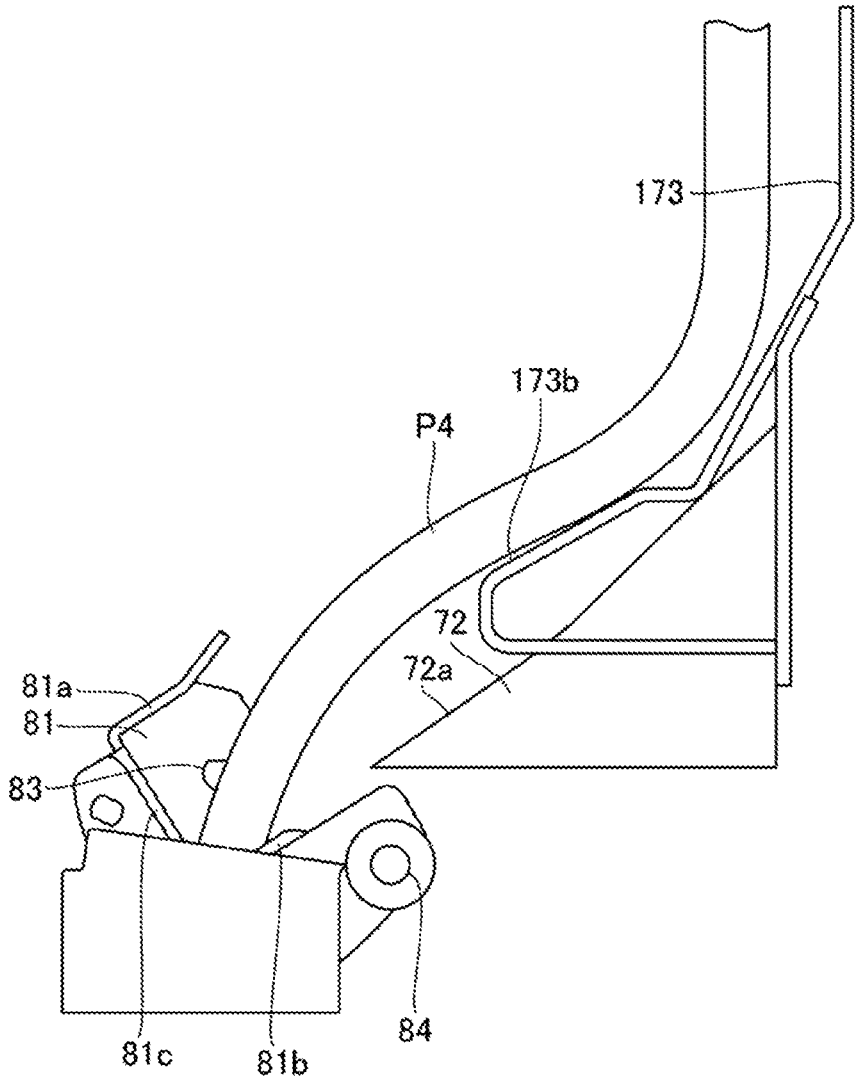
FIG. 21 is a view for illustrating an example in which, in the sheet bundle discharging apparatus of FIG. 7, the booklet is curved with the pushing member before laying the booklet.

When the rotating operation of the spine receiver 81 and the pushing operation of the pushing member 73 are started at the same time without synchronization, an attitude of the booklet before being laid is important. For example, as illustrated in FIG. 21, it is important that a projecting portion 173*b* projecting toward the conveyance belt 92 side be formed at a part of the pushing member 173 and that the shape of the booklet before being laid be curved with the projecting portion 173*b*. FIG. 21 is a view for illustrating an example in which, in the sheet bundle discharging apparatus K of FIG. 7, the booklet P4 is curved with the pushing member 73 before the booklet P4 is laid.

However, the booklet may be, for example, a booklet having a high stiffness and a booklet having a small size which has been subjected to trim-cutting by the cutting portion 65. Such booklets are less liable to be curled on the conveyance belt 92 at the fore edge of the booklet as illustrated in FIG. 14. Therefore, the sheet bundle discharging portion K2 may push down the booklet only through the pushing operation of the pushing member 73 without rotation of the spine receiver 81. Further, the booklet may be pushed down only through the rotating operation of the spine receiver 81. Further, the rotating operation of the spine receiver 81 and the pushing operation of the pushing member 73 may be driven at the same time without synchronization, or the operation speed of the pushing member 73 may be changed. For example, the booklet can be brought into the attitude illustrated in FIG. 9 or FIG. 10 by starting the rotating operation of the spine receiver 81 and the pushing operation of the pushing member 73 at the same time and setting the operation speed of the pushing member 73 to be slower. That is, through suitable selection of the content of the operation of the spine receiver 81, the timing of starting the operation of the pushing member 73, and the operation speed of the pushing member 73 in accordance with the stiffness and the size of the booklet, damage on the booklet can be reduced at the time of laying the booklet P4 on the conveyance belt 92.

Further, although the direction of laying the booklet is set to the arrow L direction of FIG. 11 in this embodiment, the direction of laying the booklet may be set to the arrow R direction of FIG. 11. However, in that case, when the booklet is laid in the arrow R direction, there arises a need to cause the guide member configured to guide the booklet to the sheet bundle discharging portion K2 or the slope 72 of this embodiment to wait in the arrow R direction. Therefore, there is a risk in that the bookbinding apparatus becomes larger in size and more complicated in structure. Moreover, when the booklet is laid while the guide member is caused to wait, the booklet is laid while rubbing the guide member. As a result, there is a risk of damaging the cover sheet of the booklet. As a countermeasure against that risk, a surface of the guide member may be smoothened to prevent damage on the cover sheet. However, there arises a problem in that production cost increases by the amount in association with the work of smoothening the guide member. Due to the reason described above, in the sheet bundle discharging portion K2 of this embodiment, the rotating operation of the spine receiver 81 and the pushing operation of the pushing member 73 are synchronized to lay the booklet in the arrow L direction of FIG. 11, thereby minimizing the rubbing on the surface of the booklet and preventing damage on the cover sheet of the booklet.

FIG. 12 and FIG. 13 are views for illustrating the state corresponding to the processing of Step S114 and Step S115 in which the rotating operation of the spine receiver 81 and the pushing operation of the pushing member 73 have been terminated. When the spine receiver 81 has terminated its rotating operation, and the booklet is placed on the conveyance belt 92, the spine receiver upper guide 81*a* is brought into a state of being substantially parallel to an angle of a conveyor stay 91, and is located at a position of not projecting toward the booklet side with respect to the conveyor stay 91. As a result, as illustrated in FIG. 22, when the conveyance belt 92 conveys the booklet in the arrow Q direction to discharge the booklet toward the near side of the bookbinding apparatus, the surface of the booklet is not rubbed against the spine receiver upper guide 81*a*, thereby being capable of preventing damage on the cover sheet.

When there is given a configuration that generates a sufficient frictional resistance between the spine receiver bottom plate 81*c* and the spine portion P4*b* of the booklet P4, the spine receiver upper guide 81*a* is not always required. However, when the spine receiver upper guide 81*a* is provided, the booklet P4 can be stably laid. That is, when slippage occurs between the spine receiver bottom plate 81*c* and the end portion of the booklet P4, or when the booklet P4 has a large thickness, the spine receiver upper guide 81*a* regulates a position of the spine portion P4*b*, thereby being capable of stably laying the booklet P4. Further, when the spine receiver upper guide 81*a* is provided, with the use of a space defined between the spine receiver upper guide 81*a* and the spine receiver lower guide 81*b* as the receiving port, the booklet P4 which moves while being guided by the slope 72 can be reliably guided to the spine receiver 81. That is, the spine receiver 81 includes the receiving port configured to receive the sheet bundle when being in the waiting position. The receiving port approaches the sheet bundle delivery portion 90 when the spine receiver 81 rotates from the booklet receiving position to the discharge position.

Further, in FIG. 12 and FIG. 22, the sheet bundle delivery portion 90 serving as the discharging unit includes the conveyance belt 92 being an endless belt configured to discharge the booklet P4 to the outside of the sheet bundle discharging apparatus K. Such sheet bundle delivery portion 90 is configured to perform a discharge operation of discharging the booklet P4 after the spine receiver 81 places the booklet P4 on the conveyance belt 92 of the sheet bundle delivery portion 90. The conveyance belt 92 includes the inclined surface that is inclined with respect to the horizontal direction. The inclined surface includes the first portion and the second portion that is located at the position lower than the first portion. The second portion is closer to the spine receiver 81 than the first portion in the horizontal direction. That is, the conveyance belt 92 is inclined so that the spine portion P4*b* of the stacked booklet P4 becomes lower than a fore edge P4*c*. In this embodiment, the sheet bundle delivery portion 90 is arranged so as to be inclined toward the spine receiver 81. This is for the purpose of preventing the booklet having the smooth cover sheet from slipping in the arrow L direction of FIG. 12 and FIG. 22 and slipping off the sheet bundle delivery portion 90 in the arrow L direction due to the force given when the booklet is placed on the conveyor stay 91 and the conveyance belt 92 by the rotating operation of the spine receiver 81 and the pushing operation of the pushing member 73.

(Circulation Start Timing of Conveyance Belt 92)

In the processing of Step S118 to the processing of Step S122, when the booklet P4 is stacked on the sheet bundle delivery portion 90 (FIG. 22), the bookbinding apparatus controller 102 (FIG. 24) allows the discharge motor MT to operate, to thereby circulate the conveyance belt 92 in the discharging direction of the booklet (arrow Q direction). The conveyance belt 92 conveys the booklet in the arrow Q direction, to thereby discharge the booklet to the outside of the bookbinding apparatus B on the near side. That is, the booklet is discharged to the front side of a user.

It is required that the conveyance belt 92 be circulated after the booklet is stacked on the sheet bundle delivery portion 90 as illustrated in FIG. 12 and FIG. 13. That is, it is required that the conveyance belt 92 perform the discharge operation after the operation of laying the booklet by the spine receiver 81 is terminated. This is for the purpose of preventing skew feed of the booklet at the moment at which the booklet is brought into contact with the conveyance belt 92 when the booklet is stacked on the circulating conveyance belt 92. When the skew feed of the booklet is excessive, there is a risk in that a discharge detecting portion 93 provided on downstream in the discharging direction cannot detect the booklet. Therefore, the circulation start timing of the conveyance belt 92 is set after the stacking of the booklet on the conveyance belt 92. The booklet discharge sensor 94S detects whether or not the booklet has been discharged to the outside of the apparatus. When the booklet is discharged to the outside of the apparatus, the bookbinding apparatus controller 102 (FIG. 24) allows the discharge motor MT to rotate forward and allows the pushing member motor MP to reversely rotate, to thereby return the spine receiver 81 to the booklet receiving position (waiting position) and return the pushing member 73 to the waiting position. With this, the series of bookbinding operations by the bookbinding apparatus B is terminated. Next, when there is another booklet to be conveyed, the bookbinding apparatus B repeats the above-mentioned operation to sequentially discharge the booklet to the outside.

When there is employed a configuration in which the conveyance belt 92 and the spine receiver 81 are connected to the discharge motor MT through intermediation of individual clutches, after the booklet is discharged to the outside of the apparatus, the clutch provided between the discharge motor MT and the conveyance belt 92 is turned off, and the clutch provided between the discharge motor MT and the spine receiver 81 is turned on, thereby driving the discharge motor MT to return the spine receiver 81 to the booklet receiving position (waiting position).

In the description above, the sheet bundle delivery portion 90 is formed of, for example, the conveyor stay 91 and the conveyance belt 92. However, a slider (discharging unit) having a downward slope in the arrow Q direction of FIG. 22 to allow the booklet to slip off by its own weight may be provided. Alternatively, a roller conveyor (discharging unit) may be provided.

Further, in place of the configuration in which the side surface of the booklet is pushed down with the pushing member 73, there may be employed a configuration in which an upper part of the booklet is gripped with a gripper to lay the booklet.

Another Embodiment

Figure 17:
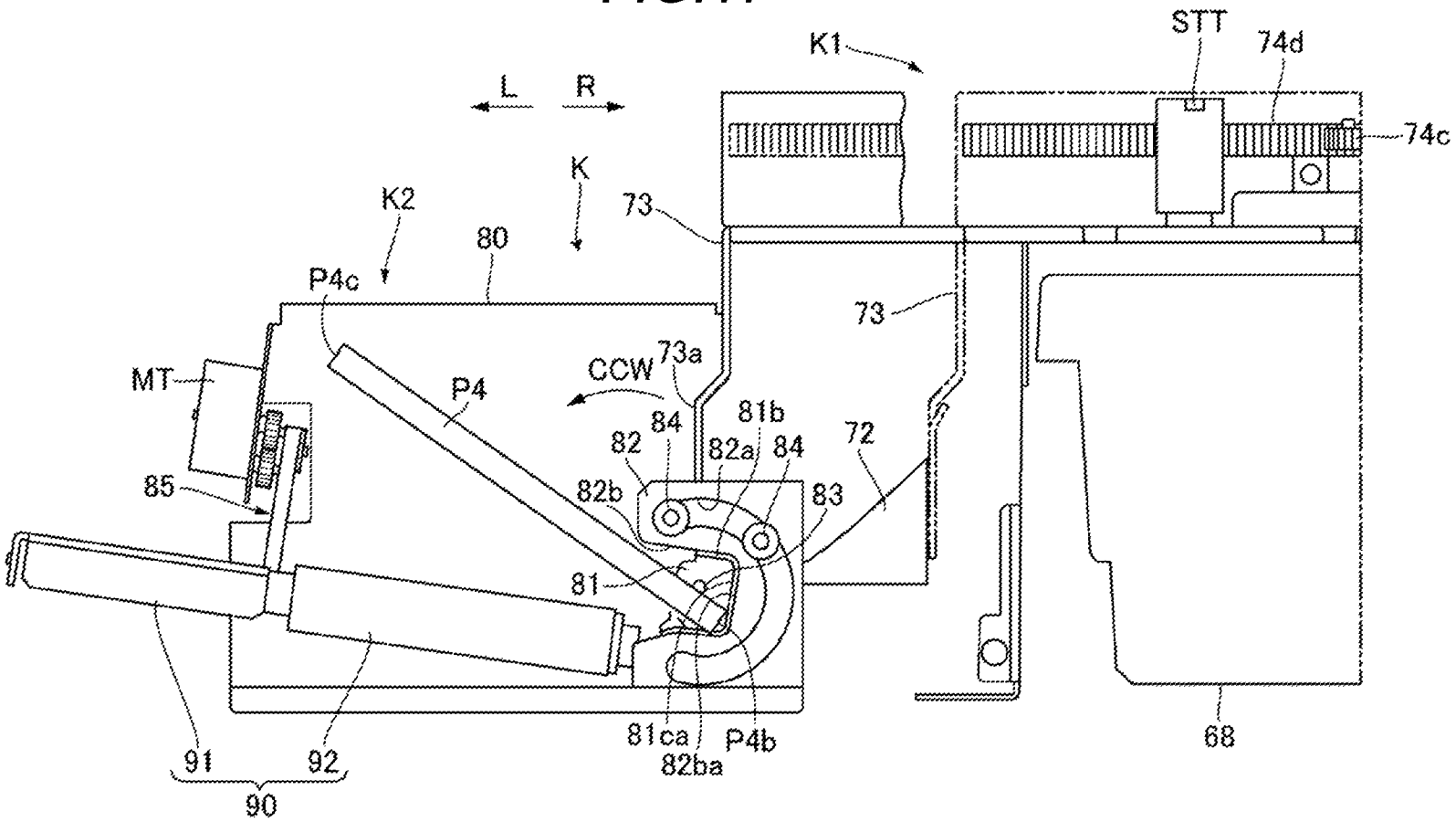
FIG. 17 is a view for illustrating an attitude of the booklet when the booklet is laid with an optimum spine-receiver previous-rotation angle.

As illustrated in FIG. 9 to FIG. 12, the sheet bundle discharging portion K2 allows the spine receiver 81 to perform the rotating operation to curve the booklet P4 and then starts the pushing operation of pushing the booklet with the pushing member 73, thereby pushing down the booklet on the conveyance belt 92. This is because of the following reason. At the time of laying a booklet having a low stiffness, a booklet having a long length in the conveyance direction of the booklet, or a booklet having a large number of inner sheets, when the operations of the spine receiver 81 and the pushing member 73 are not synchronized, in the course of pushing down the booklet, the fore edge P4*c* side (side opposed to the spine portion P4*b*) of the booklet P4 is previously laid. Then, as illustrated in FIG. 14, the portion of the fore edge P4*c* of the booklet is curled on the conveyance belt 92, and there is a risk of causing booklet jamming or causing a hitting mark or damage on the booklet surface. Therefore, with regard to the sheet bundle discharging portion K2, in order to prevent the hitting mark or damage at the time of conveyance of the booklet, it is important to stabilize the behavior of the booklet at the time of laying (stacking) the booklet P4 on the sheet bundle delivery portion 90 as illustrated in FIG. 17.

Figure 15:
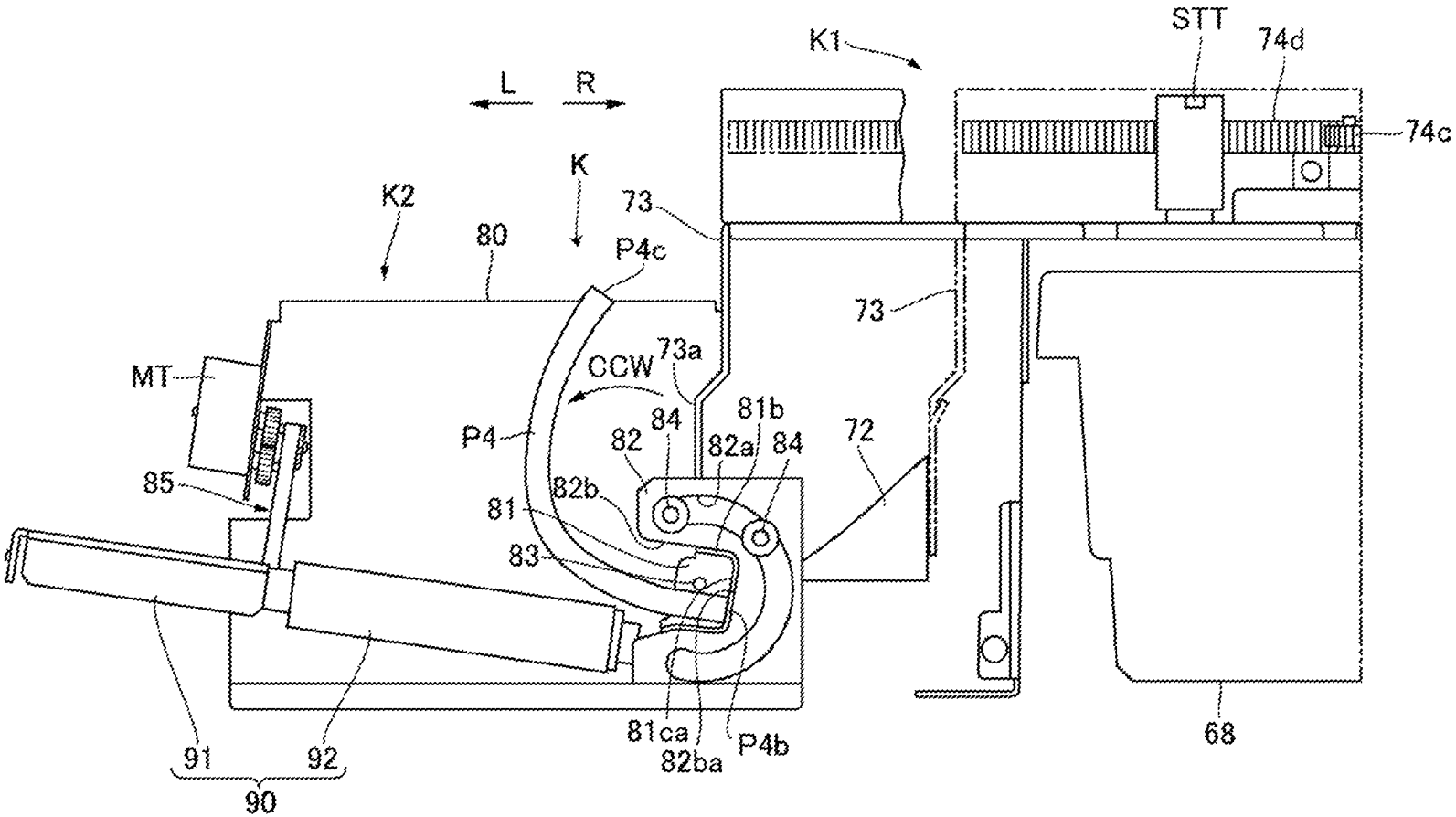
FIG. 15 is a view for illustrating a state in which the booklet bounces on a sheet bundle delivery portion to be stacked thereon.
Figure 16:
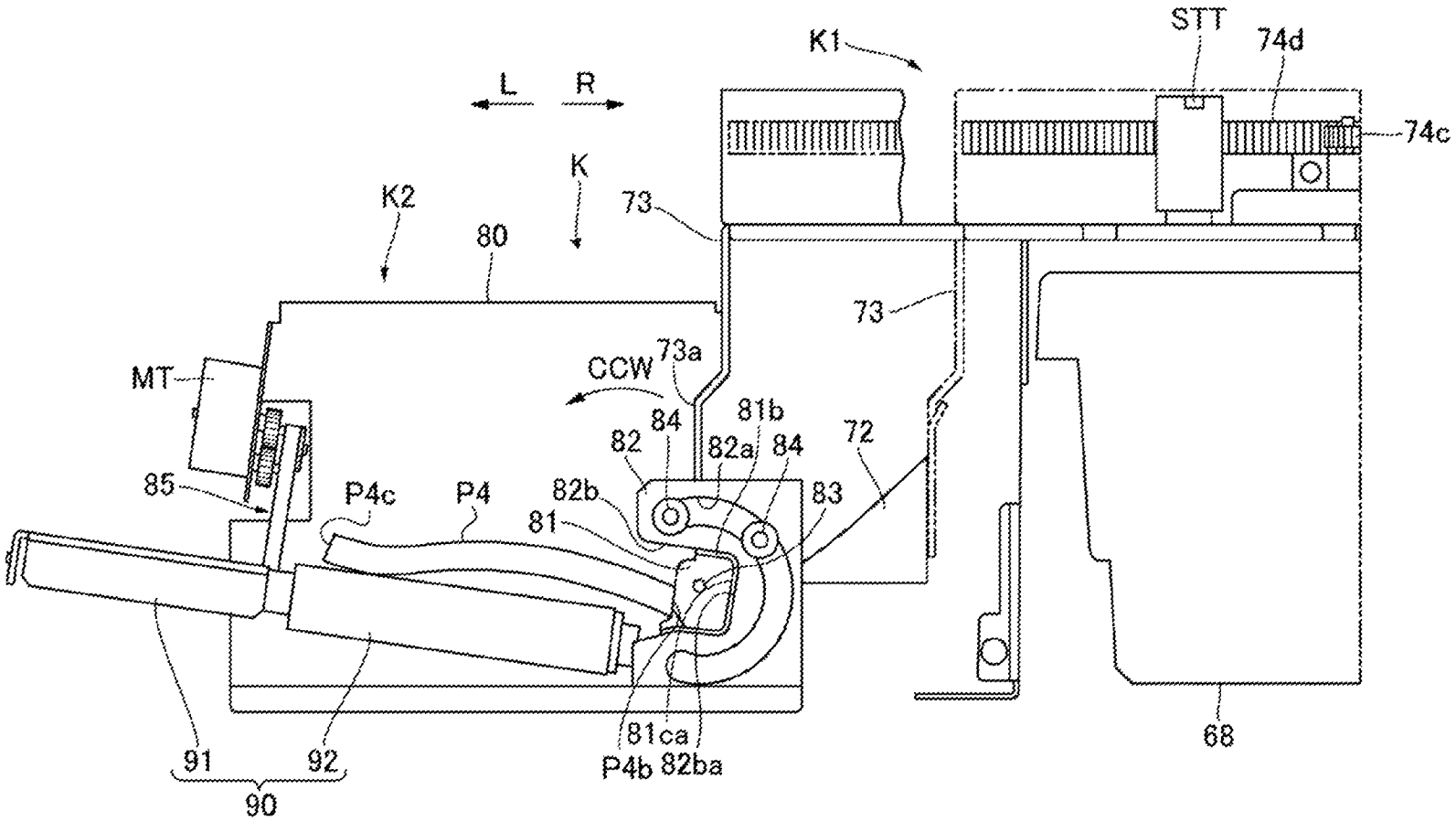
FIG. 16 is a view for illustrating a state in which the booklet bounces as illustrated in FIG. 15 and separates away from the spine receiver.

FIG. 15 is a view for illustrating a state in which the booklet bounces on the sheet bundle delivery portion 90 to be stacked thereon. FIG. 16 is a view for illustrating a state in which the booklet bounces as illustrated in FIG. 15 and separates away from the spine receiver. FIG. 17 is a view for illustrating an attitude of the booklet when the booklet is laid with an optimum spine-receiver previous-rotation angle.

As illustrated in FIG. 15, depending on the stiffness of the booklet P4, the booklet P4 may bounce when stacking the booklet P4 on the sheet bundle delivery portion 90. In such a case, as illustrated in FIG. 16, the booklet P4 jumps in the left direction of FIG. 16 so that the spine portion P4*b* separates away from the spine receiver 81. As a result, in some cases, the booklet P4 is not detected by the booklet discharge sensor 94S (FIG. 22) provided on the downstream side in the discharging direction of the booklet (arrow Q direction in FIG. 22). With regard to the booklet P4 that is not detected by the booklet discharge sensor 94S (FIG. 22), it cannot be detected whether or not the booklet P4 has been discharged from the sheet bundle delivery portion 90 to the outside. Therefore, it is important to stabilize the behavior of the booklet when laying (stacking) the booklet P4 on the sheet bundle delivery portion 90, as illustrated in FIG. 17.

However, the stiffness of the booklet P4 varies depending on, for example, the size of the booklet or the number of inner sheets of the booklet, and those are selected by a user. Thus, booklets having various stiffness may be conveyed to the sheet bundle delivery portion 90. Therefore, in the sheet bundle discharging portion K2 of this embodiment, the spine receiver 81 previously starts rotating before the pushing member 73 starts moving in the arrow L direction of FIG. 7 irrespective of a kind of the booklet to be conveyed, and the pushing member 73 starts moving in the arrow L direction after a lapse of time for rotation by a predetermined angle (optimum spine-receiver previous-rotation angle). Accordingly, the behavior of the booklet when being laid is stabilized, thereby preventing the booklet jamming and the hitting mark and damage on the booklet surface.

For that purpose, the sheet bundle discharging apparatus K according to this embodiment changes a predetermined time interval from when the spine receiver 81 starts rotating until the pushing member 73 starts moving, that is, changes the predetermined time interval in accordance with the basis weight of sheets, the finished size of the booklet (length of the booklet in the conveyance direction), and the number of inner sheets of the booklet, and lays the booklet by a method suited for the stiffness of the booklet.

Now, description is made of the operation in which the sheet bundle discharging apparatus K changes the predetermined time interval from when the spine receiver 81 starts rotating until the pushing member 73 starts moving in accordance with stiffness information of the booklet and lays the booklet on the sheet bundle delivery portion 90 in a stable state.

Figure 18A:
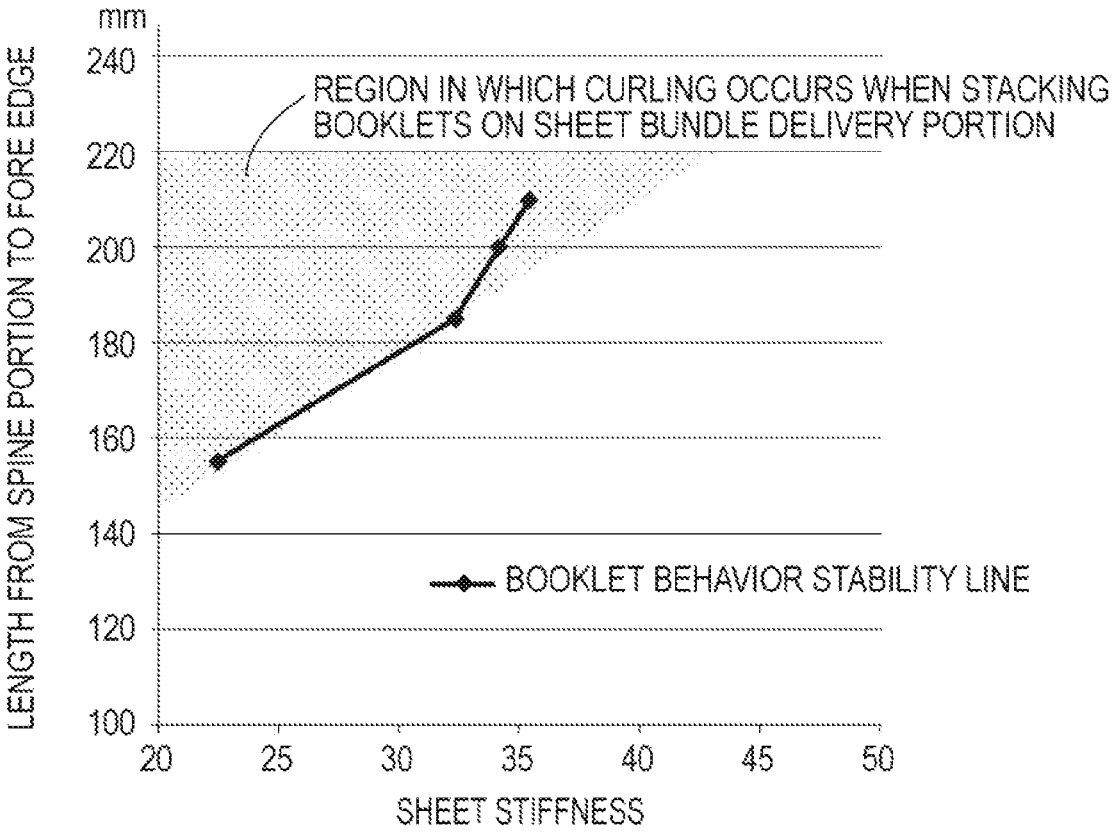
FIG. 18A is a graph of a test result showing that the booklet is curled depending on the stiffness of sheets and the length of the booklet when stacking the booklet on the sheet bundle delivery portion.

FIG. 18A is a graph of a test result showing that the booklet is curled depending on the stiffness of the sheets and the length of the booklet when stacking the booklet on the sheet bundle delivery portion 90.

Figure 18B:
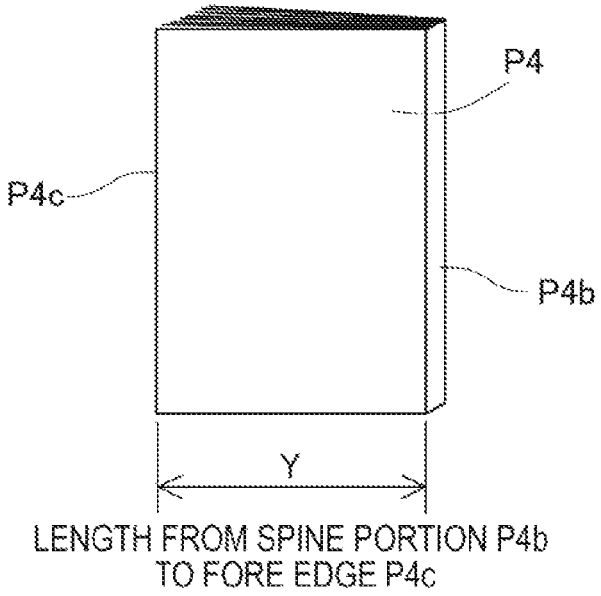
FIG. 18B is a view for illustrating a length from a spine portion to a fore edge of the booklet.

The length of the booklet is a length Y from the spine portion P4*b* to the fore edge P4*c* of the booklet P4, which is obtained by subjecting a sheet bundle covered with a cover sheet to trim-cutting with the cutting portion 65 (FIG. 2) and bookbinding the resultant as illustrated in FIG. 18B. The length of a sheet bundle covered with a cover sheet in the case of not being subjected to the trim-cutting with the cutting portion 65 is equal to a length of the inner sheets.

In the graph of FIG. 18A, the vertical axis represents the length of the booklet, and the horizontal axis represents the stiffness of the sheets. The sheet stiffness is the Clark stiffness of each sheet. The Clark stiffness is a numerical value of a measurement value obtained by sandwiching a test piece of a sheet cut into a predetermined length between a pair of rolls, rotating the pair of rolls rightward and leftward, and measuring a protruding length of the test piece protruding from the rolls given when an angle of the test piece laid rightward and leftward is 90 degrees.

The graph of FIG. 18A shows that a booklet having a low stiffness formed of sheets having a low stiffness is liable to be curled when stacking the booklet on the sheet bundle delivery portion 90 even when the length of the booklet is short. Meanwhile, the graph of FIG. 18A shows that a booklet having a high stiffness formed of sheets having a high stiffness is less liable to be curled when stacking the booklet on the sheet bundle delivery portion 90 when the length of the booklet is short. The Clark stiffness and the sheet basis weight are proportional to each other. Specifically, as the Clark stiffness is higher, the sheet basis weight is also higher.

The bookbinding apparatus controller 102 (FIG. 24) serving as a control unit sets the spine-receiver previous-rotation angle in accordance with the basis weight of the sheets and the length of the booklet as the stiffness information of the booklet input to the operation panel 18 (FIG. 1 and FIG. 24) by a user. That is, the operation panel 18 is an acquiring unit configured to acquire information relating to at least one of the size of the sheet bundle, the basis weight of the sheets of the sheet bundle, and the number of sheets of the sheet bundle.

The bookbinding apparatus controller 102 controls the pushing member 73 and the spine receiver 81 such that the spine receiver (receiving unit) 81 precedes the pushing member (laying means) 73 to start the rotating operation of laying the sheet bundle. The spine receiver 81 rotates at a constant speed. Therefore, the bookbinding apparatus controller 102 starts the movement of the pushing member 73 after a lapse of a predetermined operation start time interval from starting the rotation of the spine receiver 81, thereby being capable of adjusting an angle of rotation of the spine receiver 81 preceding the start of the operation of the pushing member 73. Based on the stiffness information of the booklet, the bookbinding apparatus controller 102 is capable of setting the operation start time interval between the pushing member 73 and the spine receiver 81 to a first time interval when a first stiffness is given, or setting the operation start time interval to a second time interval longer than the first time interval when a second stiffness smaller than the first stiffness is given. That is, the bookbinding apparatus controller 102 controls a timing of starting the operation of the pushing member 73 based on the information acquired from the operation panel 18.

When the stiffness information of the booklet corresponds to the basis weight of the sheets of the booklet (FIG. 19), the bookbinding apparatus controller 102 controls the pushing member 73 and the spine receiver 81 by setting the operation start time interval between the pushing member 73 and the spine receiver 81 to, for example, 800 ms (first time interval) when a basis weight of from 81 g to 105 g (first stiffness and first basis weight) is given, or setting the operation start time interval to 1,100 ms (second time interval) when a basis weight of from 64 g to 80 g (second stiffness and second basis weight) smaller than the first basis weight is given.

In the case described above, the pushing member 73 starts the operation after a lapse of the predetermined time in accordance with the basis weight after the spine receiver 81 starts rotating. However, the operation of the pushing member 73 may be started after the spine receiver 81 starts rotating and rotates to a predetermined rotation angle in accordance with the basis weight. That is, the operation of the pushing member 73 may be started by setting the predetermined rotation angle of the spine receiver 81 to be larger as the basis weight is smaller. A method of detecting the rotation angle of the spine receiver 81 is described later.

Further, when the stiffness information of the booklet corresponds to the length of the booklet (FIG. 19), the bookbinding apparatus controller 102 controls the pushing member 73 and the spine receiver 81 by setting the operation start time interval between the pushing member 73 and the spine receiver 81, for example, for sheets having a basis weight of from 52 g to 63 g to 800 ms (first time interval) when a booklet having an A5 size (first stiffness and first length) is given, or setting the operation start time interval to 1,100 ms (second time interval) when a booklet having an A4 size (second stiffness and second length) larger than the A5 size in length. The stiffness of the booklet is smaller as the length of the booklet is larger.

Also in this case, the pushing member 73 starts the operation after a lapse of the predetermined time in accordance with the length of the booklet after the spine receiver 81 starts rotating. However, the operation of the pushing member 73 may be started after the spine receiver 81 starts rotating and rotates to a predetermined rotation angle in accordance with the length of the booklet. That is, the operation of the pushing member 73 may be started by setting the predetermined rotation angle of the spine receiver 81 to be larger as the length of the booklet is larger. A method of detecting the rotation angle of the spine receiver 81 is described later.

Moreover, the bookbinding apparatus controller 102 (FIG. 24) serving as control means is also configured to set the spine-receiver previous-rotation angle in accordance with the number of inner sheets of the booklet input to the operation panel 18 (FIG. 1 and FIG. 24) by a user.

Figures 20A, 20B:
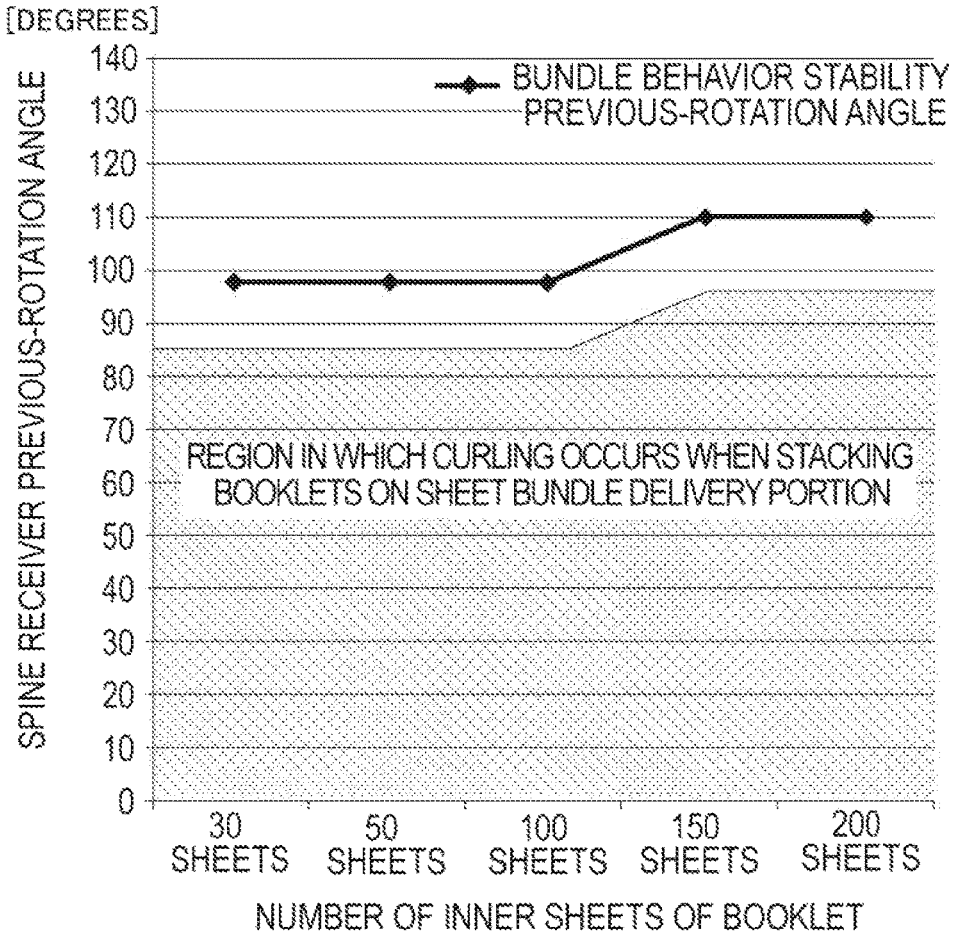
FIG. 20A is a graph of a test result showing a relationship between the number of inner sheets of the booklet and the optimum spine-receiver previous-rotation angle.
FIG. 20B is a table of a test result for showing an operation start timing of the pushing member with respect to the number of inner sheets of the booklet.

FIG. 20A is a graph of a test result for showing a relationship between the number of inner sheets of the booklet and the optimum spine-receiver previous-rotation angle. In the graph of FIG. 20A, the vertical axis represents the spine-receiver previous-rotation angle, and the horizontal axis represents the number of inner sheets of the booklet. The optimum spine-receiver previous-rotation angle is an angle at which, when stacking the booklet on the sheet bundle delivery portion 90, the booklet assumes an inclined attitude having linearity as illustrated in FIG. 17 in the course of being laid. At this time, the booklet is laid without being previously laid on the fore edge side, and hence the booklet is laid without bouncing on the sheet bundle delivery portion 90.

FIG. 20B is a table of a test result showing an operation start timing of the pushing member 73 with respect to the number of inner sheets of the booklet. According to the table of the test result shown in FIG. 20B, when the number of inner sheets of the booklet exceeds about 100 sheets, the bookbinding apparatus controller 102 (FIG. 24) takes a longer time from when the spine receiver 81 starts rotating until the pushing member 73 starts moving. This is because, when the number of inner sheets of the booklet is large, the own weight of the booklet increases as compared to the case in which the number of inner sheets is small, and the fore edge side of the booklet is more liable to hang down, with the result that the booklet is more liable to be curled. Therefore, the bookbinding apparatus controller 102 (FIG. 24) takes a longer time from when the spine receiver 81 starts rotating until the pushing member 73 starts moving as the number of inner sheets of the booklet becomes larger, thereby laying the booklet in the optimum attitude.

That is, based on the information of the number of inner sheets, the bookbinding apparatus controller 102 controls the pushing member 73 and the spine receiver 81 by setting the operation start time interval between the pushing member 73 and the spine receiver 81, for example, to 800 ms (first time interval) when the number of inner sheets shown in FIG. 20B is from 31 sheets to 50 sheets (the first number of sheets), or setting the operation start time interval to 1,100 ms (second time interval) longer than 800 ms (first time interval) when the number of inner sheets is from 101 sheets to 150 sheets (the second number of sheets) larger than the number of inner sheets from 31 sheets to 50 sheets (the first number of sheets).

Also in this case, the pushing member 73 starts the operation after a lapse of the predetermined time in accordance with the number of inner sheets of the booklet after the spine receiver 81 starts rotating. However, the movement of the pushing member 73 may be started after the spine receiver 81 starts the rotation and rotates to the predetermined rotation angle in accordance with the number of inner sheets of the booklet. That is, the movement of the pushing member 73 may be started by setting the predetermined rotation angle of the spine receiver 81 to be larger as the number of inner sheets of the booklet is larger.

In the description above, the pushing member 73 starts the operation (movement) after a lapse of the predetermined time in accordance with the stiffness of the booklet from when the spine receiver 81 starts rotating. The predetermined time is determined by the bookbinding apparatus controller 102 based on a rotation pulse of the discharge motor MT obtained after the spine receiver home position sensor SHP (FIG. 22) detects the spine receiver 81.

Further, in the description above, the pushing member 73 starts the operation (movement) after a lapse of the predetermined time in accordance with the stiffness of the booklet from when the spine receiver 81 starts rotating. However, the pushing member 73 may start the operation (movement) at the time when the spine receiver 81 rotates to the predetermined rotation angle in accordance with the stiffness of the booklet. The predetermined rotation angle of the spine receiver 81 given in this case is determined by the bookbinding apparatus controller 102 based on a rotation pulse of the discharge motor MT obtained after the spine receiver home position sensor SHP (FIG. 22) detects the spine receiver 81.

The rotation angle of the spine receiver 81 may be detected by a plurality of sensors provided in a rotation region of the spine receiver 81.

In this embodiment, the angle by which the spine receiver 81 rotates before the start of the operation of the pushing member 73 can be set based on the pieces of information such as the length of the booklet, the basis weight of the sheets, and the number of inner sheets of the booklet. For the setting of the previous-rotation angle of the spine receiver 81, the previous-rotation angle can be set based on at least one of the above-mentioned pieces of information. Moreover, when the previous-rotation angle of the spine receiver 81 is to be set based on information of a plurality of kinds, among numerical values set based on the pieces of information, the maximum numerical value is employed as the setting value, thereby being capable of stabilizing the attitude of the sheet bundle at the time of laying.

Further, in this embodiment, the length of the booklet, the basis weight of the sheets, and the number of inner sheets of the booklet are acquired as the stiffness information from the operation panel 18 through input by a user, but may be acquired from the image forming apparatus controller 101 or an external PC.

Further, in this embodiment, description is made of the case in which the bookbinding apparatus controller 102 controls the pushing member 73 and the spine receiver 81. However, the sheet bundle discharging apparatus K may have a separate controller. In this case, based on the information of the stiffness of the booklet received from the bookbinding apparatus controller 102, the controller for the sheet bundle discharging apparatus K controls the pushing member 73 and the spine receiver 81.

The present invention is not limited to the embodiments described above, and various changes and modifications can be made without departing from the spirit and scope of the present invention. The following claims are appended hereto in order to make the scope of the present invention public.

This application claims the benefit of Japanese Patent Application No. 2018-014187 filed on Jan. 30, 2018, Japanese Patent Application No. 2018-169207 filed on Sep. 10, 2018, Japanese Patent Application No. 2018-245918 filed on Dec. 27, 2018, and Japanese Patent Application No. 2019-006723 filed on Jan. 18, 2019, which are hereby incorporated herein by reference herein in their entirety.

REFERENCE SIGNS LIST

A: image forming apparatus, B: bookbinding apparatus, C: post-processing apparatus, D: image forming system, K: sheet bundle discharging apparatus, K1: cutting scrap collecting portion, K2: sheet bundle discharging portion, MT: discharge motor, SS: slope sensor, STH: pushing member home position sensor, STT: pushing position sensor, SHP: spine receiver home position sensor, P1: inner sheet bundle, P2: cover sheet, P3: sheet bundle covered with cover sheet, P4: booklet, P4*b*: spine portion of booklet (downstream end portion in conveyance direction), P4*c*: fore edge of booklet, 18: operation panel (acquiring means), 40: stacking portion, 55: adhesive applying portion, 60: cover sheet binding portion (binding means), 64: bundle attitude deflecting portion, 65: cutting portion, 72: slope (guide unit), 72*a*: slope inclination surface, 73: pushing member (laying means), 74: pushing member driving portion (laying means), 80: frame, 81: spine receiver (receiving unit), 81*a*: spine receiver upper guide (regulating portion), 81*b*: spine receiver lower guide (pushing portion), 81*c*: spine receiver bottom plate (contact portion), 81*ca*: booklet receiving surface (flat surface), 82:

guide plate, 82*b*: cutout, 82*ba*: far edge, 90: sheet bundle delivery portion (discharging unit), 91: conveyor stay, 92: conveyance belt, 102: bookbinding apparatus controller (controller)

The invention claimed is:

1. A booklet discharging apparatus configured to discharge a booklet provided with a spine, the booklet discharging apparatus comprising:

a conveyance unit configured to convey the booklet with the spine of the booklet being a leading edge;

a guide unit configured to guide the booklet conveyed by the conveyance unit, wherein the booklet guided by the guide unit is moved with the spine of the booklet being the leading edge;

a receiving unit configured to receive the booklet guided by the guide unit; and a discharging unit configured to discharge the booklet to an outside of the booklet discharging apparatus, wherein the receiving unit includes:

(1) a contact portion with which the spine of the booklet, moved while being guided by the guide unit, is to be brought into contact; and (2) a pushing portion, which is formed integrally with the contact portion, and which is configured to push a first surface of the booklet, and wherein the receiving unit is rotatable between a first position and a second position, and is configured to receive the booklet by the contact portion contacting the spine in the first position and then rotate from the first position to the second position, thereby allowing the pushing portion to push the first surface of the booklet and to place the booklet on the discharging unit in a state of a second surface of the booklet being lower than the first surface of the booklet, the second surface being opposite to the first surface.

2. The booklet discharging apparatus according to claim 1, wherein a direction of a rotation center line around which the receiving unit is rotated from the first position to the second position is substantially parallel to a longitudinal direction of the contact portion.

3. The booklet discharging apparatus according to claim 1, wherein the receiving unit includes a receiving port configured to receive the booklet when the receiving unit is in the first position, and wherein the receiving port approaches the discharging unit when the receiving unit is rotated from the first position to the second position.

4. The booklet discharging apparatus according to claim 1, wherein, while the receiving unit rotates from the first position to the second position, a moving direction of the booklet given when the booklet is seen from above intersects with a moving direction of the booklet being discharged by the discharging unit.

5. The booklet discharging apparatus according to claim 1, wherein the receiving unit includes a regulating portion configured to regulate a movement of the second surface of the booklet when the receiving unit is in the first position, and wherein the regulating portion is opposed to the pushing portion and is formed integrally with the contact portion.

6. The booklet discharging apparatus according to claim 5, wherein the receiving unit includes a first flat surface serving as the contact portion, a second flat surface serving as the pushing portion, and a third flat surface serving as the regulating portion, and wherein the second flat surface and the third flat surface are adjacent to the first flat surface and are opposed to each other.

7. The booklet discharging apparatus according to claim 1, wherein the discharging unit includes an endless belt configured to discharge the booklet to an outside of the booklet discharging apparatus.

8. The booklet discharging apparatus according to claim 7, wherein the endless belt includes an inclined surface inclined with respect to a horizontal direction, wherein the inclined surface includes a first portion and a second portion located at a position lower than the first portion, and wherein the second portion is closer to the receiving unit than the first portion in the horizontal direction.

9. The booklet discharging apparatus according to claim 1, wherein the discharging unit is configured to perform a discharge operation for the booklet after the receiving unit places the booklet on the discharging unit.

10. The booklet discharging apparatus according to claim 1, further comprising a pushing unit configured to push the first surface of the booklet, wherein a position at which the pushing unit pushes the first surface is upstream of a position at which the pushing portion pushes the first surface with respect to a moving direction of the booklet guided by the guide unit.

11. The booklet discharging apparatus according to claim 10, wherein the pushing unit is configured to start pushing after the receiving unit starts rotation.

12. The booklet discharging apparatus according to claim 10, wherein a timing at which the pushing unit starts pushing is controlled in accordance with a stiffness of the booklet.

13. The booklet discharging apparatus according to claim 10, further comprising an acquiring unit configured to acquire information relating to at least one of a size of the booklet, a basis weight of a sheet of the booklet, and a number of sheets of the booklet, wherein a timing at which the pushing unit starts operation is controlled based on the information acquired by the acquiring unit.

14. A bookbinding apparatus comprising:

a binding unit configured to bind a sheet bundle into a booklet; and a booklet discharging apparatus configured to discharge the booklet provided with a spine, wherein the booklet discharging apparatus comprises:

(A) a conveyance unit configured to convey the booklet with the spine of the booklet being a leading edge;

(B) a guide unit configured to guide the booklet conveyed by the conveyance unit, wherein the booklet guided by the guide unit is moved with the spine of the booklet being the leading edge;

(C) a receiving unit configured to receive the booklet guided by the guide unit; and (D) a discharging unit configured to discharge the booklet to an outside of the booklet discharging apparatus, wherein the receiving unit includes:

(1) a contact portion with which the spine of the booklet, is moved while being guided by the guide unit, is to be brought into contact; and (2) a pushing portion, which is formed integrally with the contact portion, and which is configured to push a first surface of the booklet, and wherein the receiving unit is rotatable between a first position and a second position, and is configured to receive the booklet by the contact portion contacting the spine in the first position and then rotate from the first position to the second position, thereby allowing the pushing portion to push the first surface of the booklet and to place the booklet, on the discharging unit in a state of a second surface of the booklet being lower than the first surface of the booklet, the second surface being opposite to the first surface.

15. A bookbinding apparatus comprising:

a binding unit configured to bind a sheet bundle into a booklet;

an acquiring unit configured to acquire information relating to at least one of a size of the booklet, a basis weight of a sheet of the booklet, and a number of sheets of the booklet;

a booklet discharging apparatus configured to discharge the booklet provided with a spine; and a control unit configured to control the booklet discharging apparatus based on the information acquired by the acquiring unit, wherein the booklet discharging apparatus comprises:

(A) a conveyance unit configured to convey the booklet with the spine of the booklet being a leading edge;

(B) a guide unit configured to guide the booklet conveyed by the conveyance unit, wherein the booklet guided by the guide unit is moved with the spine of the booklet being the leading edge;

(C) a receiving unit configured to receive the booklet guided by the guide unit; and (D) a discharging unit configured to discharge the booklet to an outside of the booklet discharging apparatus, wherein the receiving unit includes:

(1) a contact portion with which the spine of the booklet, moved while being guided by the guide unit, is to be brought into contact; and (2) a pushing portion, which is formed integrally with the contact portion, and which is configured to push a first surface of the booklet, and wherein the receiving unit is rotatable between a first position and a second position, and is configured to receive the booklet by the contact portion contacting the spine in the first position and then rotate from the first position to the second position, thereby allowing the pushing portion to push the first surface of the booklet and to place the booklet on the discharging unit in a state of a second surface of the booklet being lower than the first surface of the booklet, the second surface being opposite to the first surface.

* * * * *